US009272388B2

(12) United States Patent
Misra

(10) Patent No.: US 9,272,388 B2
(45) Date of Patent: Mar. 1, 2016

(54) POLISHING SYSTEMS

(71) Applicant: NexPlanar Corporation, Hillsboro, OR (US)

(72) Inventor: Sudhanshu Misra, San Jose, CA (US)

(73) Assignee: NexPlanar Corporation, Hillsboro, OR (US)

( * ) Notice: Subject to any disclaimer, the term of this patent is extended or adjusted under 35 U.S.C. 154(b) by 0 days.

(21) Appl. No.: 13/757,163

(22) Filed: Feb. 1, 2013

(65) Prior Publication Data

US 2013/0149945 A1 Jun. 13, 2013

Related U.S. Application Data

(62) Division of application No. 12/456,546, filed on Jun. 18, 2009, now Pat. No. 8,383,003.

(60) Provisional application No. 61/132,606, filed on Jun. 20, 2008.

(51) Int. Cl.

| | |
|---|---|
| ***C23F 1/00*** | (2006.01) |
| ***B24B 39/00*** | (2006.01) |
| ***B24B 37/26*** | (2012.01) |
| ***B24B 37/04*** | (2012.01) |
| ***B24B 37/14*** | (2012.01) |
| ***B24B 57/00*** | (2006.01) |

(52) U.S. Cl.

CPC ..... *B24B 39/00* (2013.01); *B24B 37/042* (2013.01); *B24B 37/14* (2013.01); *B24B 37/26* (2013.01); *B24B 57/00* (2013.01); *Y10T 428/249953* (2015.04)

(58) Field of Classification Search

CPC ..... B24B 57/02; B24B 57/04; B24B 37/042; B24B 37/36; C23F 1/40; C23F 1/42; B24C 7/0007; H01L 21/3212; H01L 21/30625

USPC ..... 156/345.11, 345.12; 252/79.1; 438/691, 438/692, 693

See application file for complete search history.

(56) References Cited

U.S. PATENT DOCUMENTS

| | | | | |
|---|---|---|---|---|
| 6,458,289 | B1 | 10/2002 | Merchant et al. | |
| 6,974,525 | B2 * | 12/2005 | Emesh et al. | 204/212 |
| 6,979,252 | B1 | 12/2005 | Siddiqui et al. | |
| 7,138,073 | B2 | 11/2006 | Minamihaba et al. | |
| 7,192,886 | B2 | 3/2007 | Paw et al. | |
| 7,377,840 | B2 | 5/2008 | Deopura et al. | |
| 7,425,172 | B2 | 9/2008 | Misra et al. | |

(Continued)

OTHER PUBLICATIONS

Non-Final Office Action from U.S. Appl. No. 12/456,546 mailed Mar. 21, 2012, 14 pgs.

*Primary Examiner* — Lan Vinh

(74) *Attorney, Agent, or Firm* — Blakely Sokoloff Taylor Zafman LLP

(57) ABSTRACT

Described herein are polishing apparatus, polishing formulations, and polymeric substrates for use in polishing surfaces, and related methods. The apparatus, formulations, substrates, and methods may each be used in applications involving the polishing of metal and/or metal-containing surfaces such as semiconductor wafers. The apparatus, formulations, polymeric substrates, and related methods described herein may be used without abrasives, and in some instances, without mechanical friction of a pad surface against the surface to be polished. Therefore, defects on a polished surface due to such mechanical polishing processes may be reduced.

6 Claims, 15 Drawing Sheets

(56) References Cited

U.S. PATENT DOCUMENTS

Figure 1:
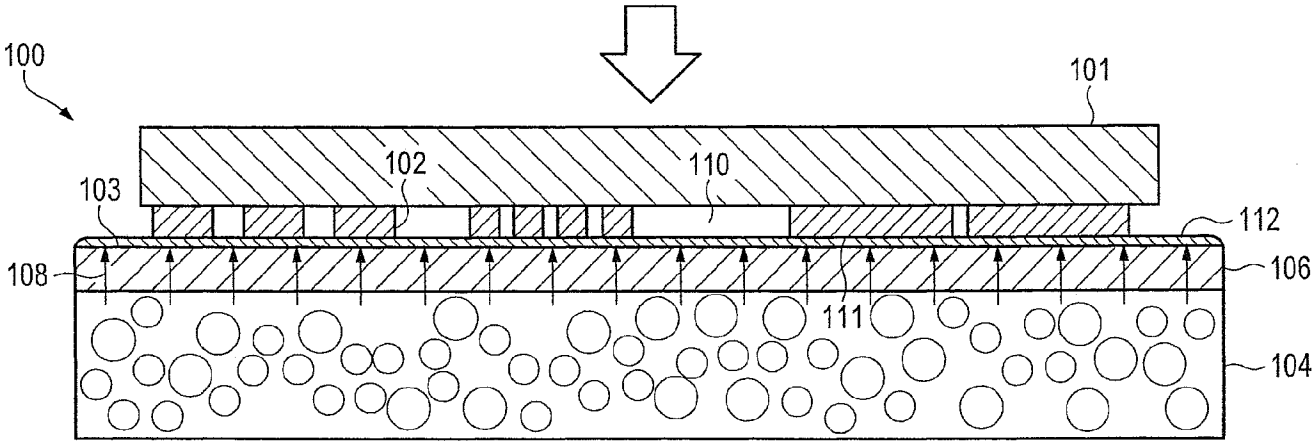

| | | | | |
|---|---|---|---|---|
| 7,720,250 | B2 | 5/2010 | Jajodia et al. | |
| 2002/0189169 | A1 | 12/2002 | Costas et al. | |
| 2003/0077995 | A1* | 4/2003 | Li et al. | 451/528 |
| 2004/0132308 | A1* | 7/2004 | Obeng | 438/692 |
| 2004/0175948 | A1 | 9/2004 | DeSimone et al. | |
| 2005/0009448 | A1 | 1/2005 | Misra et al. | |
| 2005/0016960 | A1 | 1/2005 | Nogami et al. | |
| 2006/0019587 | A1 | 1/2006 | Deopura et al. | |
| 2006/0276109 | A1 | 12/2006 | Roy et al. | |
| 2007/0051639 | A1 | 3/2007 | Mazur et al. | |
| 2008/0090498 | A1 | 4/2008 | Misra et al. | |
| 2008/0207100 | A1 | 8/2008 | Roy et al. | |
| 2008/0211141 | A1 | 9/2008 | Deopura et al. | |
| 2009/0053976 | A1 | 2/2009 | Roy et al. | |
| 2009/0078583 | A1 | 3/2009 | Kobata et al. | |
| 2009/0311955 | A1 | 12/2009 | Kerprich et al. | |

* cited by examiner

POLISHING SYSTEMS

CROSS-REFERENCE TO RELATED APPLICATIONS

This application is a divisional of U.S. patent application Ser. No. 12/456,546, filed on Jun. 18, 2009, which claims benefit of U.S. Provisional Application No. 61/132,606, filed on Jun. 20, 2008, the entire contents of which are hereby incorporated by reference herein.

FIELD

The present application relates to surface polishing and in particular to planarizing surfaces in the manufacture of semiconductor devices by the chemical removal of metal and metal-containing species.

BACKGROUND

Chemical-mechanical polishing ("CMP") is a common method used to planarize individual layers (e.g., dielectric or metal layers) during integrated circuit ("IC") fabrication on a semiconductor wafer. CMP removes undesirable topographical features of the IC on the wafer. For example, CMP may be used to remove metal deposits subsequent to damascene processes, excess oxide from shallow trench isolation steps, to planarize inter-metal dielectrics ("IMD") or in the construction of devices with complex architecture, such as system-on-a chip ("SoC") designs and vertical gate structures with varying pattern densities (e.g., FinFETs). (For additional information, see *Chemical-Mechanical Planarization of Semiconductors*, M. R. Oliver (Ed.), Springer Series in Material Science, vol. 69, 2004.)

CMP utilizes a reactive liquid medium that contains engineered abrasive particles ("slurry") and a polishing pad to provide chemical and mechanical control. The slurry, or possibly the polishing pad, in addition, may contain nano-sized inorganic particles that enhance chemical reactivity and/or mechanical activity of the CMP process. Typically, CMP is done with slurry and pad in contact with the substrate containing the surface needing to be polished (e.g., blanket or patterned wafer). U.S. Pat. No. 6,458,289, for instance, discloses an emulsion-based CMP slurry that is used in this way. The emulsion-based slurry, an enhanced version of an otherwise typical particle- or abrasive-based CMP slurry, may be used as a replacement to the typical particle- or abrasive-based CMP slurries that are currently in use. As a replacement slurry, the emulsion-based slurry of U.S. Pat. No. 6,458,289 is used like other CMP slurries; i.e., the emulsion-based slurry is dispensed on the surface of a CMP polishing pad, which may or may not contain additional abrasives.

Inorganic particles in CMP slurries are known contributors to defects generated during the CMP process. These abrasive particles may generate microscratches and other defects (e.g., chatter marks) seen on polished/planarized semiconductor wafers. In addition, the polishing pad and the downforce with which the wafer is held to the polishing pad may contribute to defects on patterned wafers, most commonly dishing and erosion, both of which can detract from high flatness.

One or more features, alone or in combination, form areas or patterns of different densities which polish at different rates under current CMP practices. Differential material removal rates across regions of different pattern density result in non-uniform removal and within-die variations of film thickness. The resulting topography, which is typically better after CMP than before CMP, is still not adequately uniform and may be cause for yield loss from, for example, a variety of electrical failures. Certain regions of low pattern density clear adequately, while regions of high pattern density do not, a situation which necessitates over-polishing. Over-polishing typically results in recessed regions in large metal structures (such as bond pads), a phenomenon known as dishing, attributable to the chemical and mechanical actions of the slurry (e.g., abrasive gouging) and the pad (e.g., pad flexing). Large metal line widths (i.e., wide open areas metal) for example show large evidence of dishing on their structures.

Another effect of over-polishing is erosion of the film underneath the layer being polished (e.g., oxide in case of copper CMP, or nitride in case of shallow trench isolation CMP ("STI CMP"). Erosion is defined as the decrease in the film thickness from the originally deposited film thickness resulting from over-polishing the layer being polished above it (e.g., copper). Erosion, like dishing, may be caused by pad flexing and abrasive gouging, but typically occurs in arrays of narrow features wherein both metal and oxide are simultaneously removed. The severity of dishing and erosion on the integrity of the film stacks on a chip during CMP depends on the chemical and mechanical aspects of the CMP process and is affected by the slurry and the pad and the complex interactions of the various components of CMP. The downforce with which the wafer is held against the polishing pad is also thought to create shear stresses that can contribute to peeling and/or delamination.

Some abrasive-free CMP formulations have been described, for example, in U.S. Pat. Nos. 6,800,218, 6,451,697 and U.S. application Ser. No. 09/543,777 (now abandoned) in efforts to circumvent some of the above-mentioned problems.

Provided are effective polishing apparatus, methods, and formulations that, in a number of instances, may provide finished (e.g., lacking small-scale roughness) and flat (e.g., lacking substantial deviations in planarity) substrate surfaces. Various methods disclosed herein may be highly efficient, cost effective, and environmentally friendly, especially useful in light of today's heightened environmental consciousness.

SUMMARY

Described herein are polishing apparatus, polishing formulations, polymeric substrates for use in polishing surfaces, and related methods. The apparatus, formulations, substrates and methods may each be used in applications involving the polishing of semiconductor wafers, e.g., polishing a metallized surface of a wafer. The apparatus, formulations, polymeric substrates, and related methods described herein may, in general, be used without abrasives, and in some instances, without mechanical friction of a pad surface against the surface to be polished. Therefore, defects on a polished surface due to such mechanical polishing processes may be reduced.

In some variations of polishing apparatus described herein, a polymeric substrate comprising a polymeric surface comprises a network of interconnected pores which may contain polishing formulations such as water-oil/organic-water ("W/O/W") emulsions. The network of pores, being interconnected, may further provide (in addition to being a polishing formulation reservoir) a means for the transport of polishing formulation throughout the polymeric substrate and up through the polymeric surface of the polymeric substrate. Polishing formulation transported through the polymeric surface of the polymeric substrate may or may not form a boundary layer or latent boundary layer of polishing formulation that may be used to contact and remove metal and/or metal-containing species from a polish substrate (e.g., semiconductor wafer).

Polymeric substrates for use in polishing metallized surfaces are described. In some instances, the polymeric substrates comprise a body and a polymeric surface. The polymeric surface of the polymeric substrate is configured to support a liquid which interfaces with a metallized surface of a polish substrate, and the body comprises an internal portion that is configured to contain one or more components of a polishing formulation. The internal portion is in fluid communication with the polymeric surface of the polymeric substrate, so that one or more components of the polishing formulation may permeate between the polymeric surface of the polymeric substrate and the internal portion of the polymeric substrate.

In some variations, the polymeric surface of the polymeric substrate may be configured to support an aqueous boundary layer, which may comprise an external aqueous phase of the polishing formulation, so that the boundary layer contacts selected regions of the metallized surface. For example, a metallized surface (e.g., semiconductor wafer) may be lowered into the aqueous boundary layer on the polymeric surface of the polymeric substrate in such a way as to allow the aqueous boundary layer to contact protrusions extending from the metallized polish substrate. In some embodiments, the polymeric surface of the polymeric substrate may be saturated with an external phase of the polishing formulation, such that the slightest amount of downforce introduced by the metallized polish substrate allows for the release of a proportionate amount of the external aqueous phase.

Any suitable polishing formulation may be used with the polymeric substrates described herein. In some variations, a polishing formulation may comprise an external aqueous phase configured to contact a metallized surface and solvate metal cations, and an organic phase configured to extract metal cations from the external aqueous phase. In these variations, the aqueous phase may form an emulsion with the organic phase providing, in certain variations, a two-phase polishing formulation. In some variations, the organic phase may further comprise an internal aqueous phase configured to strip metal cations from metal-containing complexes in the organic phase. In these variations, the organic phase and internal aqueous phase comprise a first emulsion dispersed in an external aqueous phase to provide a second emulsion. In such instances, both extraction and stripping may happen simultaneously or essentially simultaneously in the polishing formulation.

An internal portion of the polymeric substrate may have any suitable shape or configuration for containing one or more components of a polishing formulation. In some variations, the internal portion may comprise a cavity or reservoir for containing an organic phase of the polishing formulation, an aqueous phase, or a combination of these phases. In some variations, the cavity or reservoir is divided by a porous polymeric membrane, or the like, configured to support an organic phase and separate two different aqueous phases, wherein the organic phase is configured to transport particular species (e.g., metal cations) from a portion of the cavity containing an aqueous phase in direct communication with the polish substrate to a portion of the cavity containing an aqueous phase that is indirectly (i.e., through the organic phase) in communication with the polish substrate. In some variations, the internal portion may comprise an open pore network that is configured to contain one or more components of the polishing formulation, e.g., an organic phase and/or an aqueous phase. For example, an open pore network may comprise an organic phase of the polishing formulation. In some variations, the internal portion of the polymeric substrate may comprise one or more hollow tubular structures configured to support an organic phase and separate two different aqueous phases, wherein the organic phase is configured to transport particular species (e.g., metal cations) from an aqueous phase outside the one or more hollow tubular structures to an aqueous phase inside the internal or hollow portion of the one or more hollow tubular structures.

Polishing apparatus are also described herein. In general, the polishing apparatus are configured for removing metal and/or metal-containing species from a metallized surface of a polish substrate to form a polished surface. In general, the apparatus comprise a polish substrate holder (e.g., wafer chuck) configured to support the polish substrate, one or more platens, and a polymeric substrate comprising a polymeric surface configured to support a liquid (boundary layer or latent boundary layer) which interfaces with the metallized surface. An aqueous boundary layer, which may comprise or be in fluid communication with an external aqueous phase of the polishing formulation, is disposed in a boundary region between the polymeric surface of the polymeric substrate and the metallized surface to solvate the metal cations. An organic phase of the polishing formulation extracts solvated metal cations from the external aqueous phase. In the apparatus, extraction of solvated metal cations from the external aqueous phase may occur at least partially within a body of the polymeric substrate.

In variations of the polishing apparatus, the organic phase may comprise a complexing agent that causes metal cations to be extracted from the external aqueous phase. In certain variations, the organic phase may form an emulsion with the external aqueous phase, and in some instances the organic phase may also form an emulsion with an internal aqueous phase. In the latter instances, the internal aqueous phase may comprise a stripping agent configured to cause extraction of metal cations from metal-containing complexes in the organic phase.

In some variations of the apparatus, the polymeric surface of the polymeric substrate may be porous, and the polymeric substrate body may comprise a cavity or reservoir in fluid communication with the porous polymeric surface. In these variations, the reservoir may be configured to contain at least one phase of the polishing formulation, e.g., the organic phase. In some variations, the organic phase impregnates a porous polymeric membrane, or the like, that bisects the cavity or reservoir of the polymeric substrate body. In some variations, the polymeric substrate body may comprise an open pore network in fluid communication with the porous polymeric surface of the polymeric substrate. Here, the open pore network may be configured to contain at least one phase of the polishing formulation, e.g., the organic phase. In some variations, one or more hollow tubular structures that bisect the cavity or reservoir (e.g., inside and outside portions) may be configured to support the organic phase.

The polishing apparatus may be configured to remove a variety of metals and metal-containing species from a surface of a polish substrate. For example, the polishing apparatus may be configured to remove one or more of the group consisting of copper, tantalum, titanium, copper oxide, tantalum nitride, and any other metal or metal-containing species encountered during the polishing of wafers in the production of integrated circuits. In some instances, the polishing apparatus may be configured to selectively remove one or more metals or metal-containing species from a metallized surface comprising multiple metals or metal-containing species or from a substrate mold such as Si or $SiO_2$.

The polishing apparatus may be configured to achieve a desired level of flatness on the polished surface. For example, the polishing apparatus may be configured to achieve a flatness of at least about 2 mils (1 mil=0.001 inch) over an area of about 80 square inches.

Polishing formulations such as W/O/W emulsions may comprise an aqueous source phase, an aqueous receiving phase, and a liquid membrane (organic phase) intermediate or between the source phase and the receiving phase. The source phase may comprise solvated metal cations (e.g., $Cu^{2+}$) resulting from an oxidation or dissolution process; the liquid membrane may comprise carrier/complexing agent and optionally surfactant, which may be present at both interfaces of the liquid membrane; and the receiving phase may comprise a stripping agent. Metallic Cu or cuprous or cupric oxide, for instance, enters the source phase by e.g. dissolving the metal or its oxide in an acidic source phase. Solvated metal cations such as $Cu^{2+}$ may reach the source phase/liquid membrane interface and be complexed by the complexing agent and made soluble in the liquid membrane. By diffusion or another transport mechanism, the metal complex may travel through the liquid membrane and reach the liquid membrane/receiving phase interface where it may encounter a stripping agent or a component thereof in the receiving phase (e.g., $H^+$ from an aqueous acidic solution). Complexed $Cu^{2+}$ may be exchanged for the stripping agent or component thereof. In this way, the carrier/complexing agent may transport metal cations from the source phase, across the liquid membrane, and into the receiving phase.

Methods for polishing a metallized surface of a substrate are also described herein. In some variations, the methods comprise contacting the metallized surface with an aqueous boundary layer (or latent boundary layer), wherein the boundary layer is disposed on a porous polymeric surface of a polymeric substrate. The methods further comprise forming metal cations from metal or metal-containing species on the metallized surface, and solvating the metal cations with an external aqueous phase of a polishing formulation. The methods include extracting solvated metal cations from the external aqueous phase with an organic phase of the polishing formulation. At least one of the external aqueous phase and the organic phase is capable of permeating the porous polymeric surface of the polymeric substrate. In some embodiments, multi-phase emulsion-based polishing formulations may permeate through to the porous polymeric substrate and interface with the polish substrate.

Certain variations of the methods may comprise permeating the organic phase through the porous polymeric surface to contact the external aqueous phase, while other variations may comprise permeating the external aqueous phase through the porous polymeric surface to contact the organic phase. Some methods comprise extracting solvated metal cations from the external aqueous phase at least partially within a body of the polymeric substrate below the porous polymeric surface.

Some methods may comprise agitating at least one of the external aqueous phase and the organic phase relative to the polish substrate. Certain methods may comprise moving, e.g., rotating and/or translating, at least one of the polymeric substrate and the polish substrate relative to the other of the polymeric substrate and the polish substrate. In certain variations, both the polymeric substrate and the polish substrate may be moved, e.g., the polymeric substrate and the polish substrate may each be rotated and/or translated relative to each other.

The methods may be adapted for removing a variety of metals or metal-containing species from a metallized surface of a polish substrate. For example, variations of the methods may be adapted for removing one or more of the group consisting of copper, tantalum, titanium, copper oxide, tantalum nitride, and any other metal or metal-containing species encountered during the polishing of wafers in the production of integrated circuits. In some instances, the methods may be adapted to selectively remove one or more metals or metal-containing species from a metallized surface comprising multiple metals or metal-containing species.

In the methods, any suitable technique may be used to form the metal cations from metals or metal-containing species on the metallized surface. For example, chemical oxidation may be used to form metal cations. In certain variations, metal cations may be formed electrochemically.

Other methods for polishing a metallized surface of a substrate are described herein. These methods comprise positioning the substrate so that the metallized surface opposes a polymeric surface of a polymeric substrate, forming metal cations from metal or metal-containing species on the metallized surface, providing an aqueous solution to form a boundary layer (or latent boundary layer) on the polymeric surface of the polymeric substrate, and controlling contact of the aqueous boundary layer (or latent boundary layer) and selected regions of the metallized surface by adjusting the height of the metallized surface above the surface of the polymeric substrate. The methods further comprise solvating the metal cations with the boundary layer (or latent boundary layer), and transporting the solvated metal cations across a first interface to extract the metal cations from the aqueous boundary layer (or latent boundary layer) to enter an organic phase. In some methods, the aqueous boundary layer (or latent boundary layer) in contact with the metallized surface may comprise or be in fluid communication with an external aqueous phase of a polishing formulation.

Variations of the methods may comprise complexing the solvated metal cations with a complexing agent to transport the metal cations across a first interface to enter an organic phase as a metal-containing complex. In these variations, the methods may further comprise transporting the metal-containing complex from the organic phase across a second interface to enter an aqueous phase internal to the organic phase.

In some variations of the methods, the polymeric surface of the polymeric substrate is porous, and at least one of the aqueous solutions used to form the aqueous boundary layer (or aqueous boundary layer) and the organic phase is capable of permeating the porous polymeric surface.

As with other methods described herein, these methods may be adapted for removing a variety of metals or metal-containing species from a metallized surface of a polish substrate. For example, variations of the methods may be adapted for removing one or more of the group consisting of copper, tantalum, titanium, oxides of copper, tantalum nitride, and any other metal or metal-containing species encountered during the polishing of wafers in the production of integrated circuits, or for selectively remove one or more metals or metal-containing species from a metallized surface comprising multiple metals or metal-containing species. Further, any suitable technique may be used to form the metal cations from metals or metal-containing species on the metallized surface. For example, chemical oxidation may be used to form metal cations. In certain variations, metal cations may be formed electrochemically.

Polishing formulations are also described herein. In general, the polishing formulations are 2- or 3-phase formulations substantially, essentially, or entirely free of abrasive additives. The polishing formulations comprise an external aqueous phase configured to contact a metallized surface of a polish substrate and to solvate metal cations formed from metals or metal-containing species on the metallized surface. The polishing formulations also comprise an organic phase configured to extract metal cations from the external aqueous phase. In some formulations, at least one of the external aqueous phase and the organic phase is capable of permeating through pores having a nominal or actual diameter of about 1-100 μm, such as, 1 μm, or less than 1 μm for more advanced technology needs where scaling down makes sense as device geometries shrink. The pore length may be 1-100× larger than the diameter, such as 1-10× larger than the diameter. These pores are best characterized as interconnected pores ("open" pores as opposed to "closed" pores). Some polishing formulations (e.g., emulsions such as water-oil/organic-water emulsions) comprise an internal aqueous phase comprising a stripping agent, wherein the stripping agent is configured to strip metal cations from metal-containing complexes in the organic phase.

The polishing formulations may be adapted for removing a variety of metals and/or metal-containing species from a metallized surface. For example, the polishing formulations may be adapted for removing one or more of the group consisting of copper, tantalum, titanium, copper oxide, tantalum nitride, and any other metal or metal-containing species encountered during the polishing of wafers in the production of integrated circuits, or for selectively removing one or more metals or metal-containing species from a metallized surface comprising multiple metals or metal-containing species. Selectivity for one or more metals or metal-containing species may be achieved through polishing formulations of different chemical compositions. Removal rates for one or more metals or metal-containing species may be adjusted through temperature, pressure (of delivery), flow rate, and/or chemical composition of the polishing formulation. In emulsion-based polishing formulations of the invention, droplet size and droplet concentration may also be used to adjust removal rates.

These and other features, aspects, and advantages of different variations of the invention disclosed herein will become better understood with regard to the following drawings, description, and appended claims.

DRAWINGS

FIG. 1 provides a schematic diagram of a variation of a polishing apparatus comprising a polymeric substrate.

Figure 2:
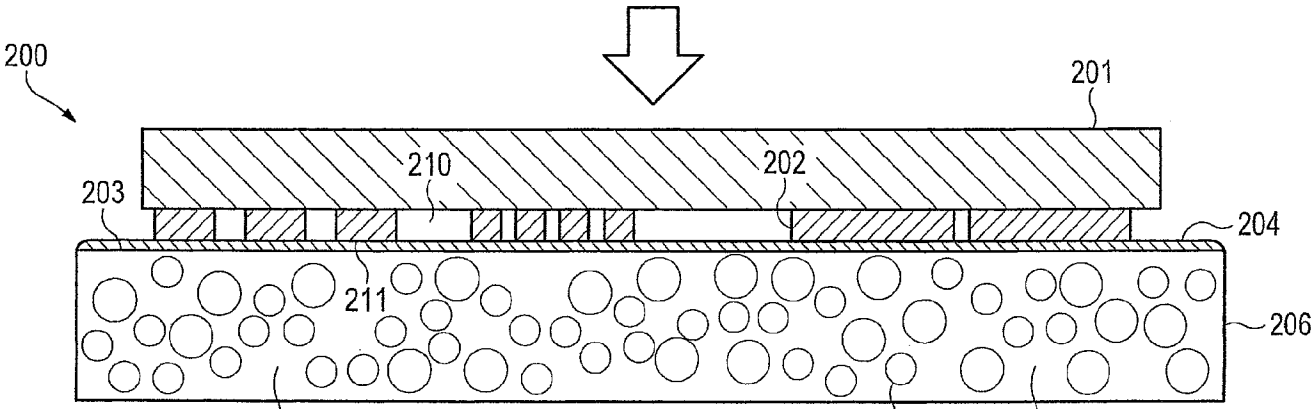

FIG. 2 provides a schematic diagram of another variation of a polishing apparatus comprising a polymeric substrate.

Figure 3:
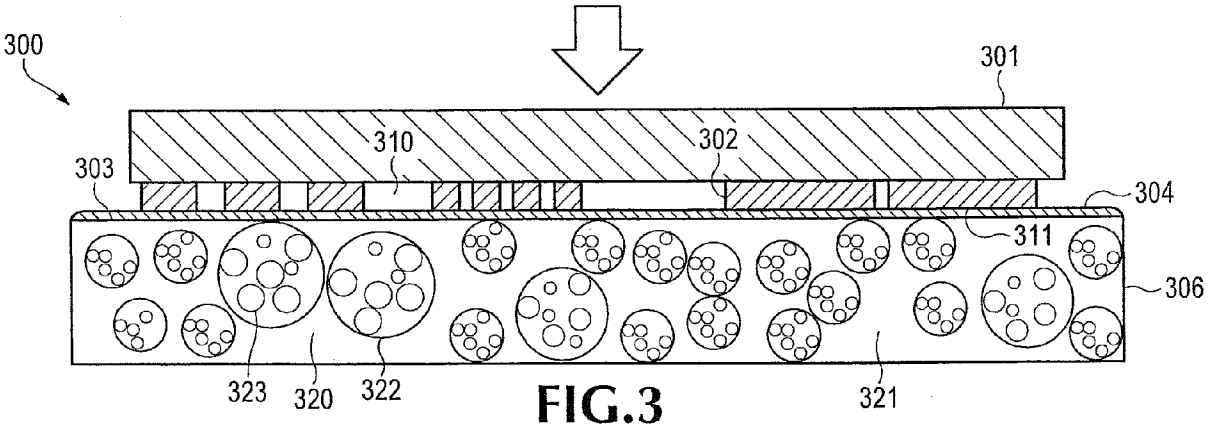

FIG. 3 provides a schematic diagram of yet another variation of a polishing apparatus comprising a polymeric substrate.

Figure 4:
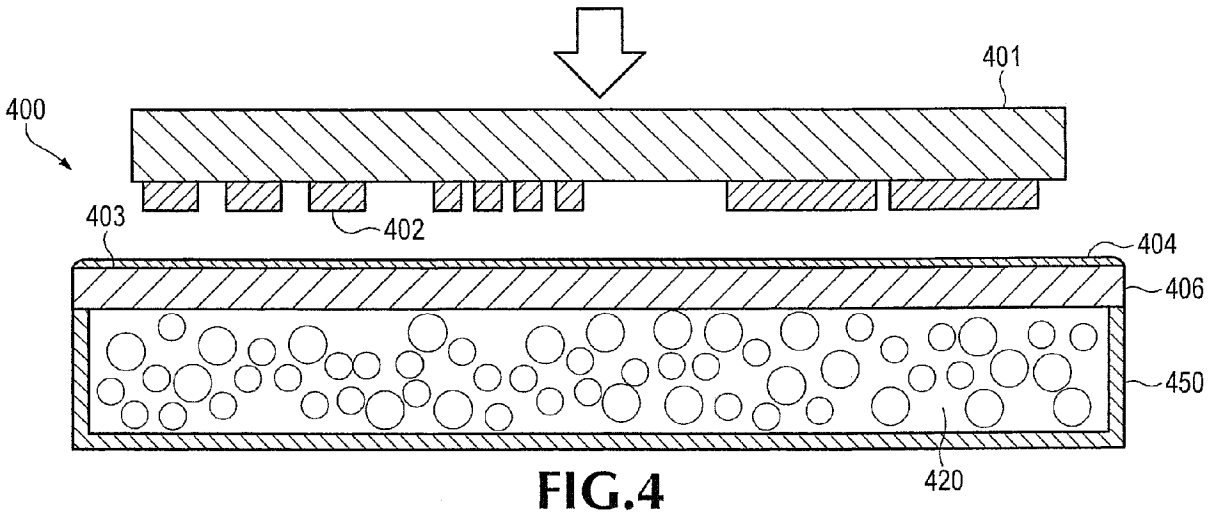

FIG. 4 provides a schematic diagram of a variation of a polishing apparatus comprising a polymeric substrate comprising a porous polymeric sheet supported on or over a reservoir comprising a polishing formulation.

Figure 5:
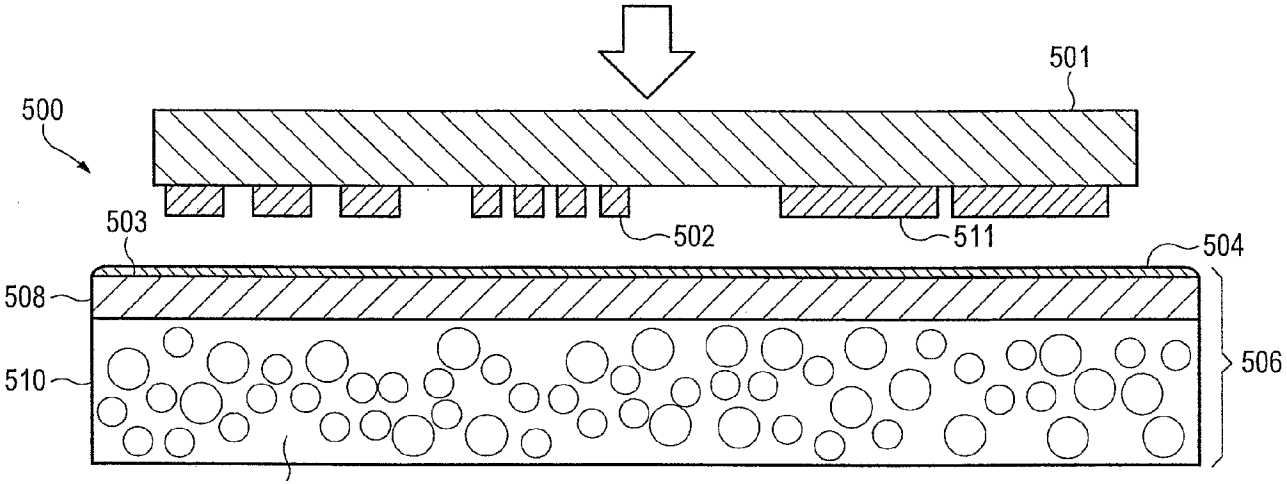

FIG. 5 provides a schematic diagram of a variation of a polishing apparatus comprising a polymeric substrate that comprises a combination of components.

Figure 6:
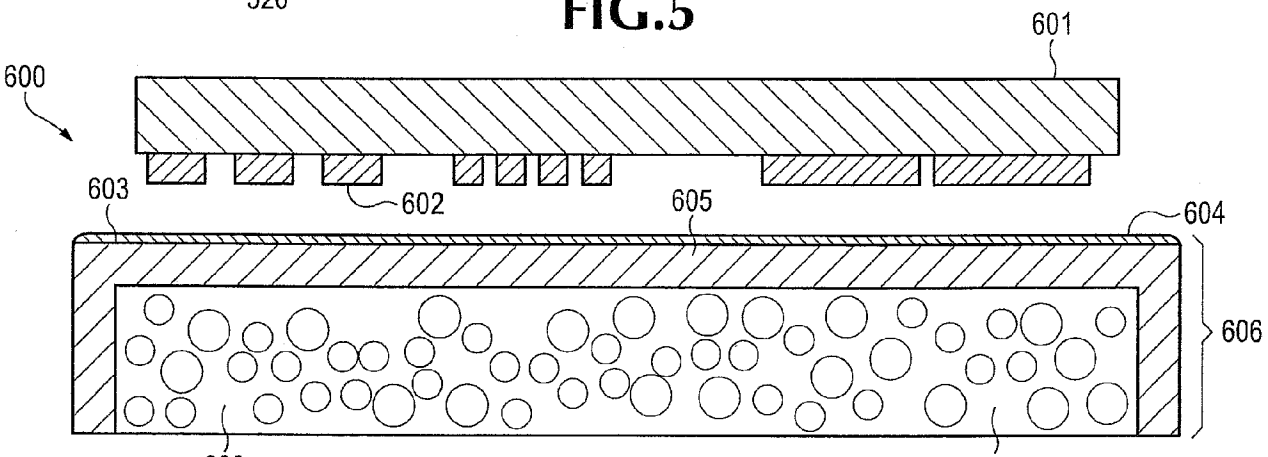

FIG. 6 provides a schematic diagram of a variation of a polishing apparatus that interfaces with a polish substrate, the polishing apparatus comprising a hollow but rigid polymeric substrate and a polymeric surface comprising a permeable top portion of the hollow polymeric substrate.

Figure 7:
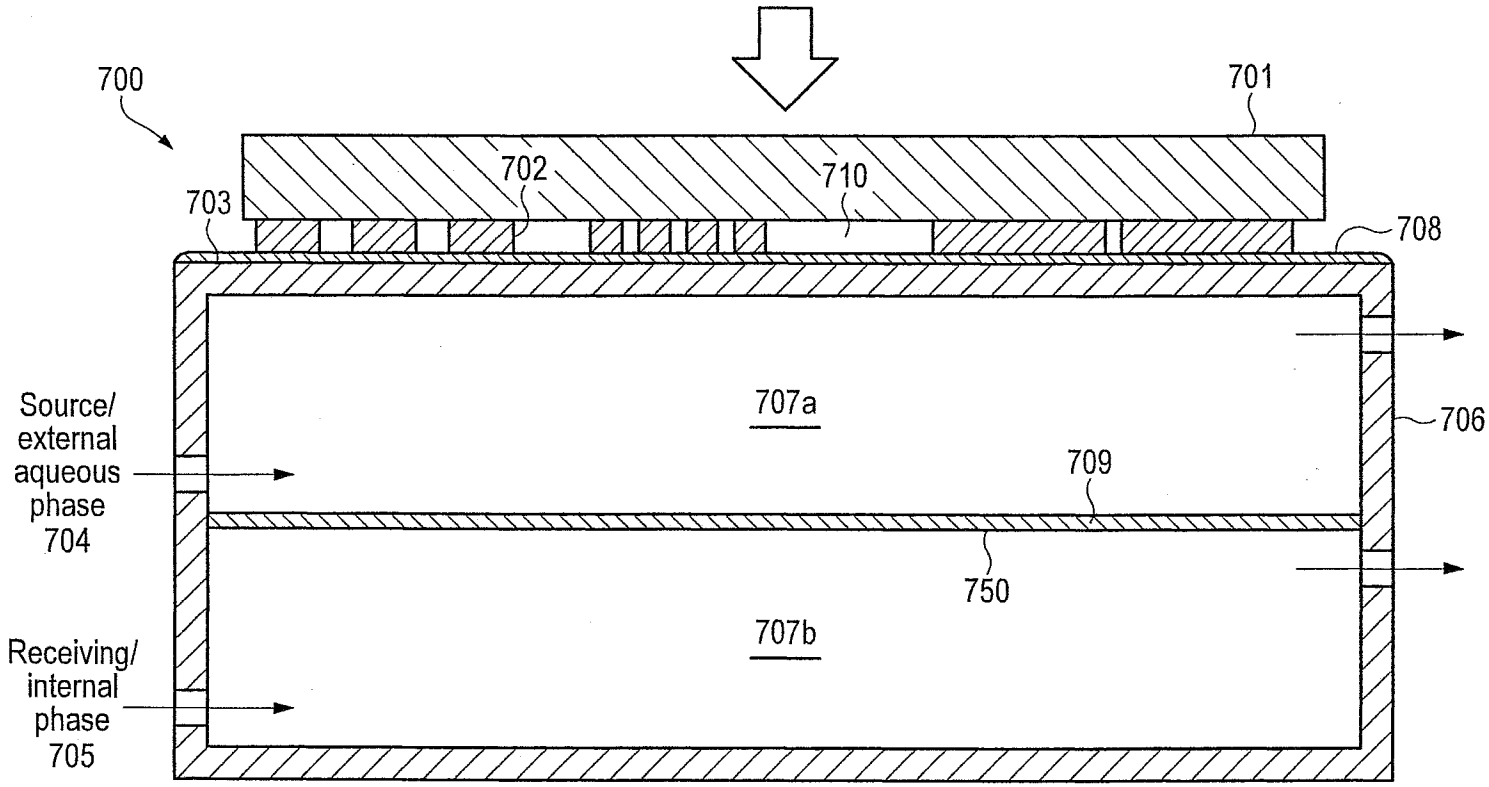

FIG. 7 provides a schematic diagram of a variation of a polishing apparatus comprising a hollow but rigid polymeric substrate, wherein the polymeric substrate comprises a supported liquid membrane.

Figure 8:
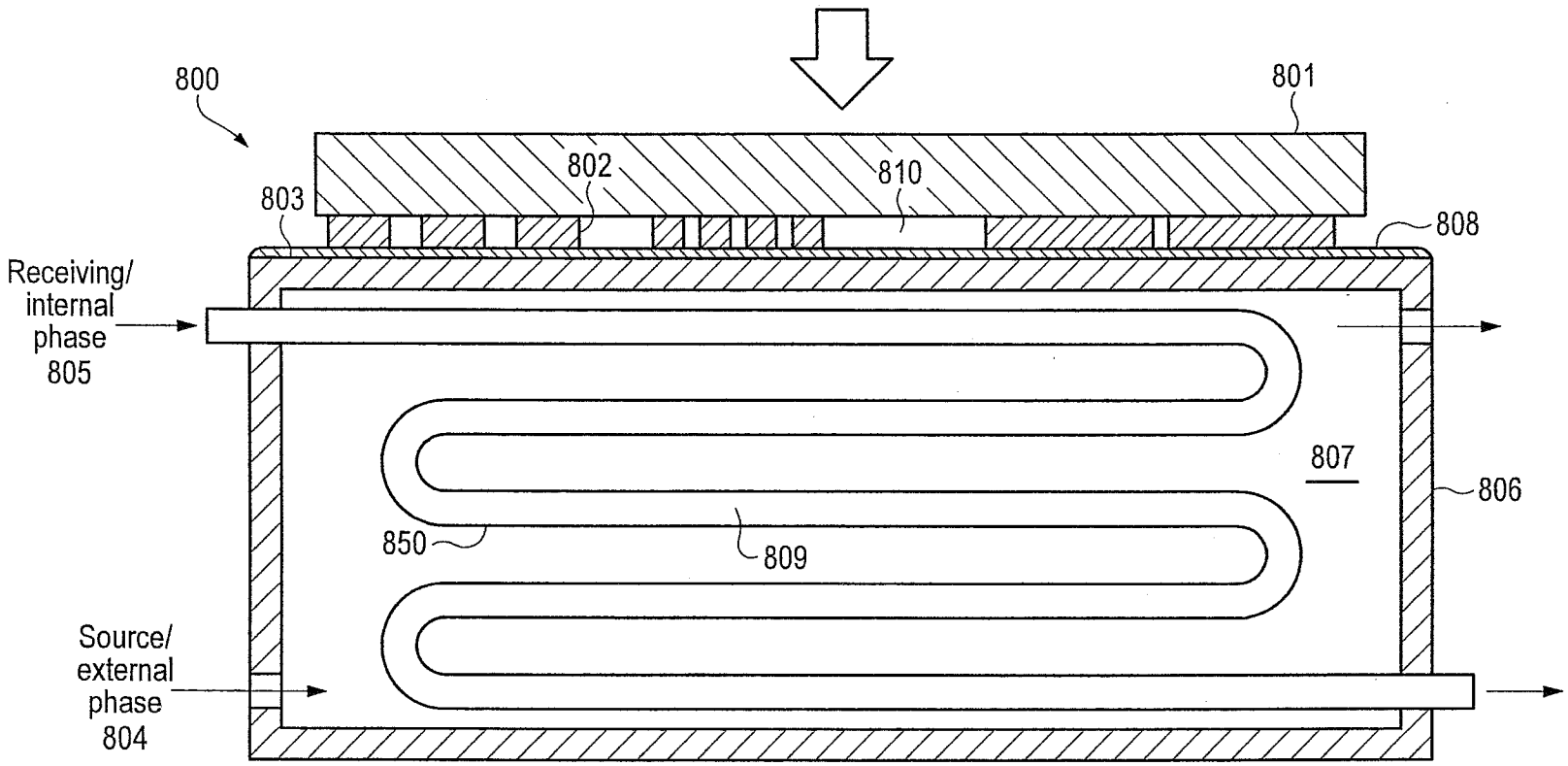

FIG. 8 provides a schematic diagram of a variation of a polishing apparatus comprising a hollow but rigid polymeric substrate, wherein the polymeric substrate comprises a hollow fiber supported liquid membrane.

Figure 9:
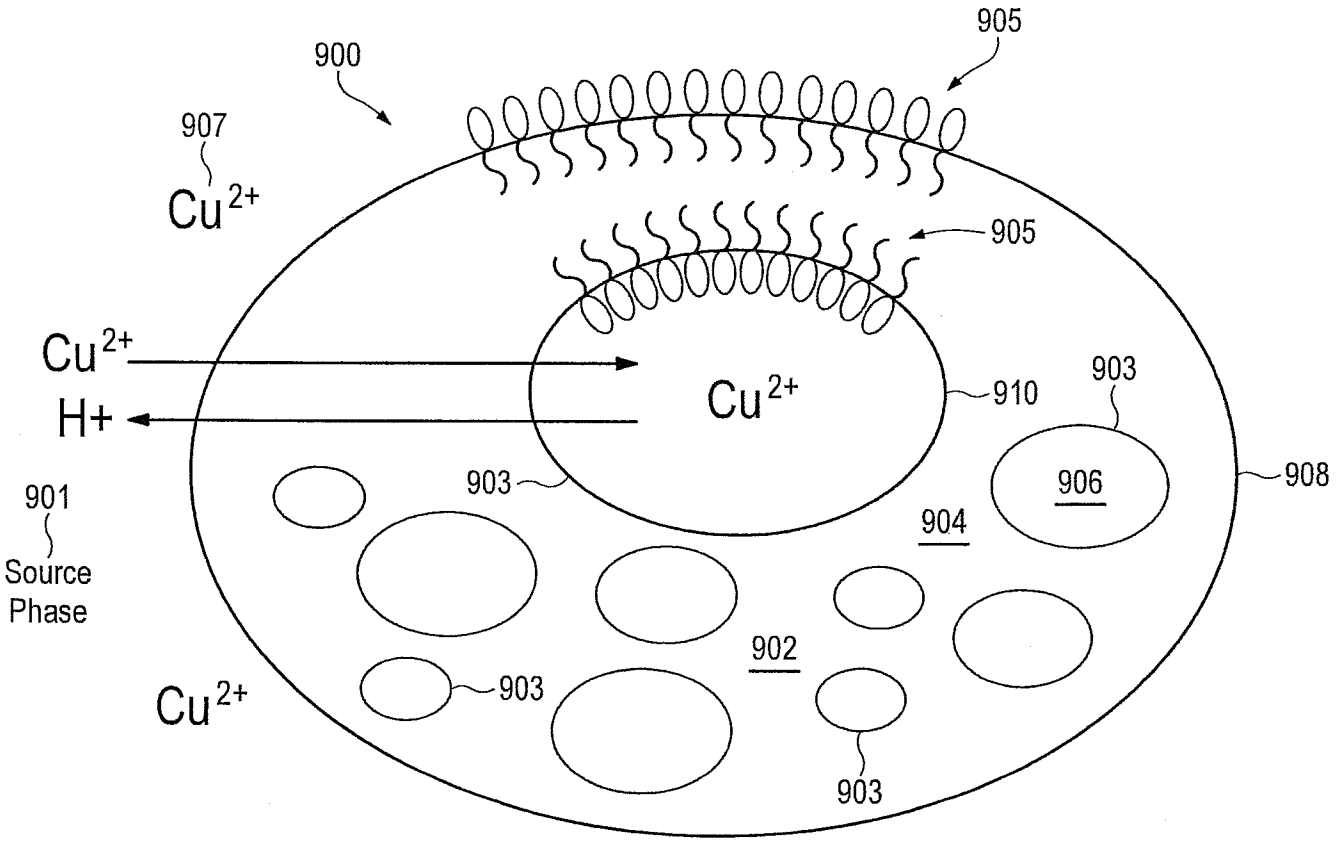

FIG. 9 provides a variation of a mechanistic scheme for the transport of metal cations through a polishing formulation in accordance with certain embodiments.

Figure 10:
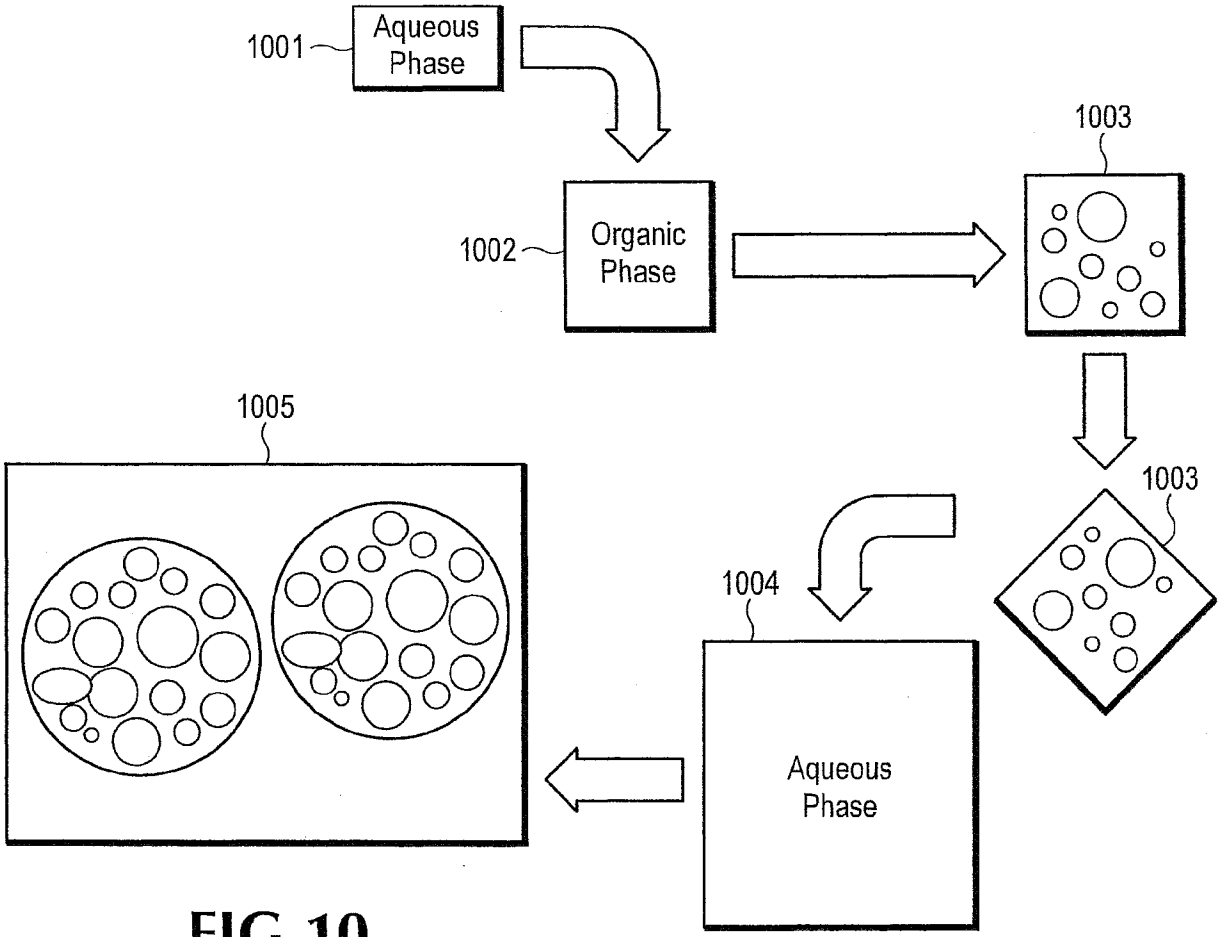

FIG. 10 provides an example of a scheme for preparing an emulsion that can be used in polishing formulations in accordance with some embodiments.

Figure 11:
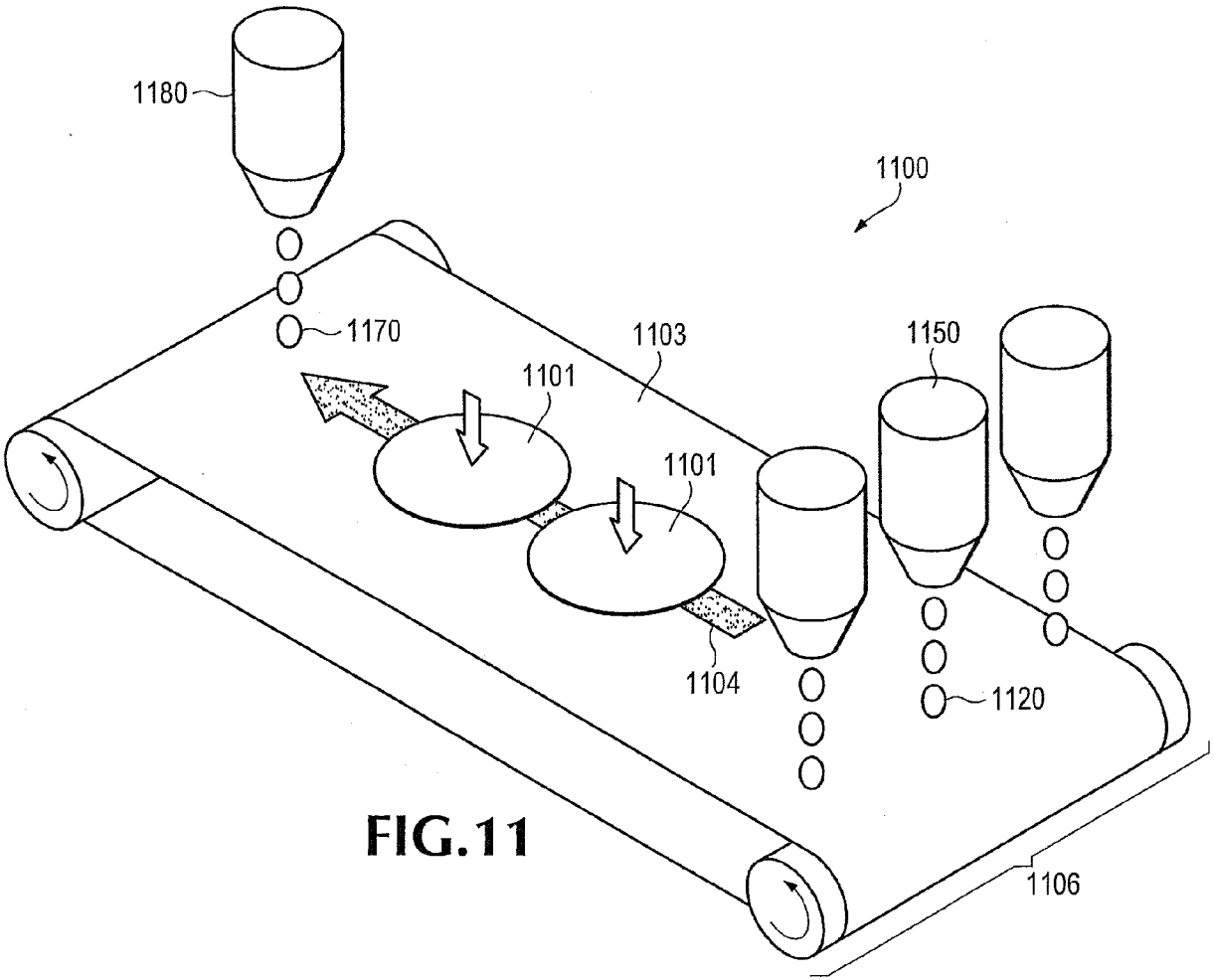

FIG. 11 provides a schematic diagram of a variation of a polishing apparatus that interfaces with one or more polish substrates, the polishing apparatus comprising a belt-type polymeric substrate.

Figure 12:
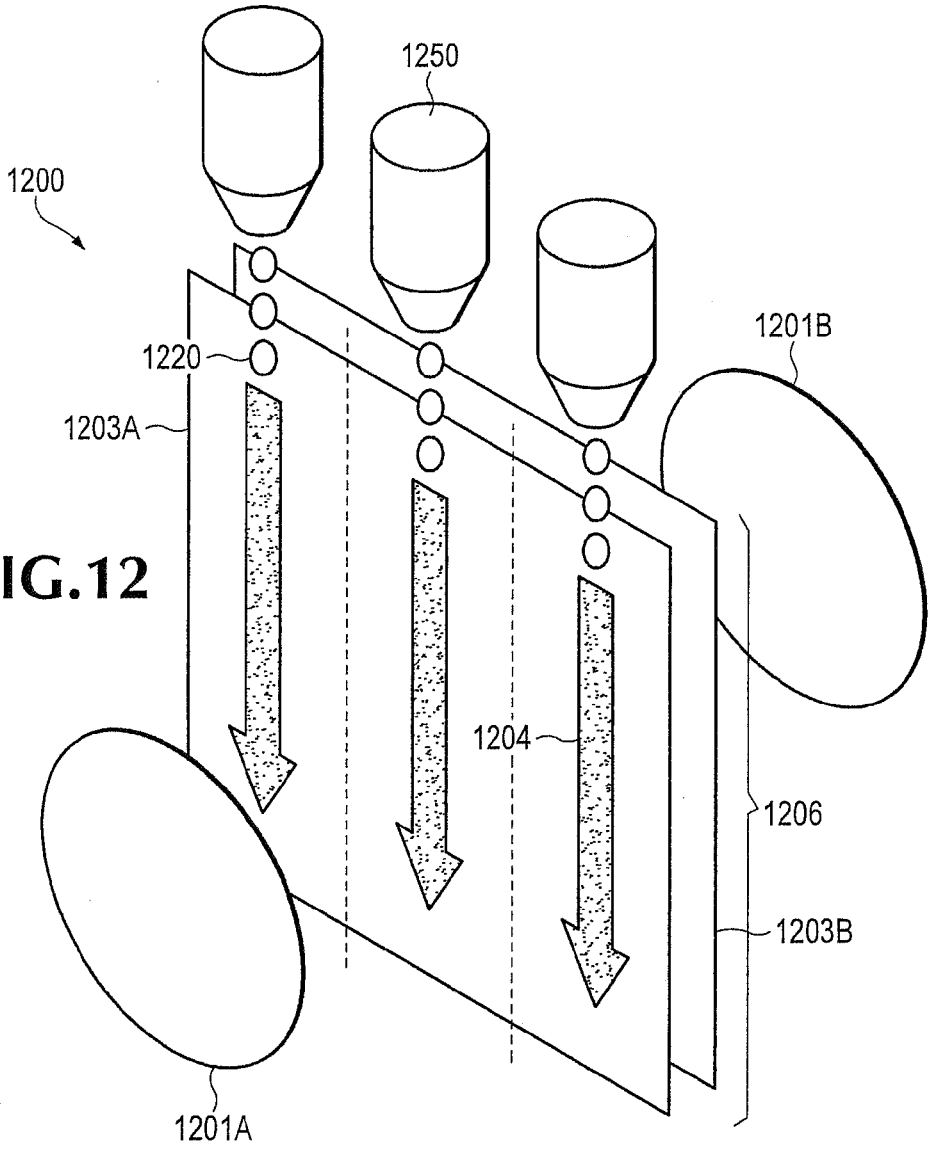

FIG. 12 provides a schematic diagram of a variation of a polishing apparatus that interfaces with one or more polish substrates, the polishing apparatus comprising a polymeric substrate which comprises two spaced polymeric surfaces.

Figure 13:
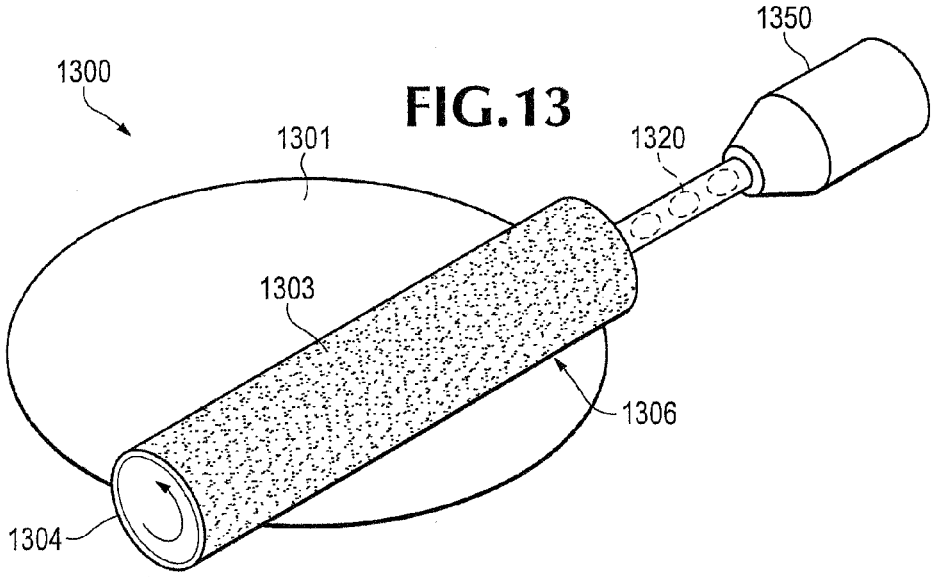

FIG. 13 provides a schematic diagram of a variation of a polishing apparatus that interfaces with a polish substrate, the polishing apparatus comprising a roller-type polymeric substrate.

Figure 14A:
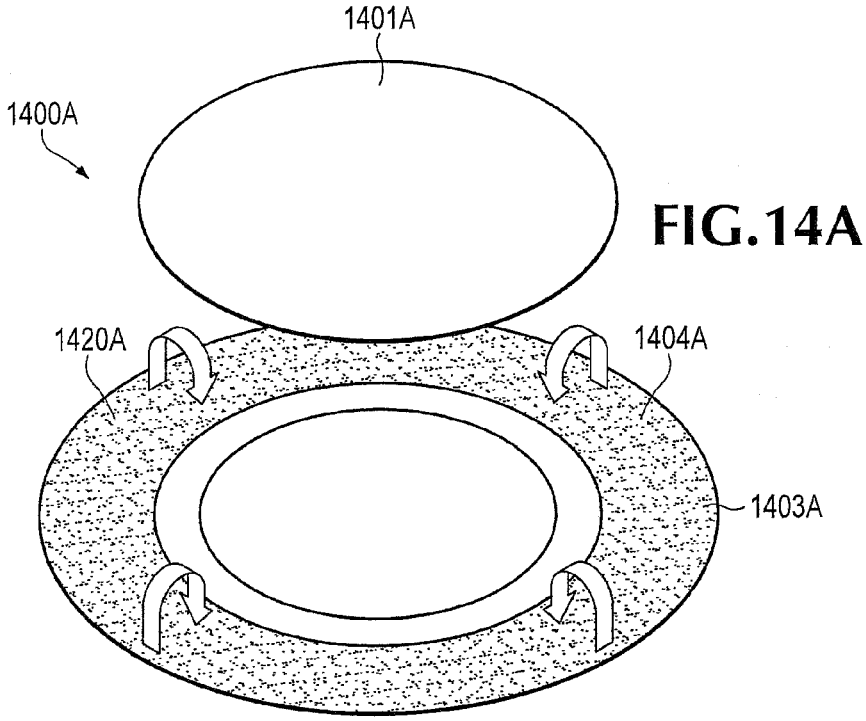
Figure 14B:
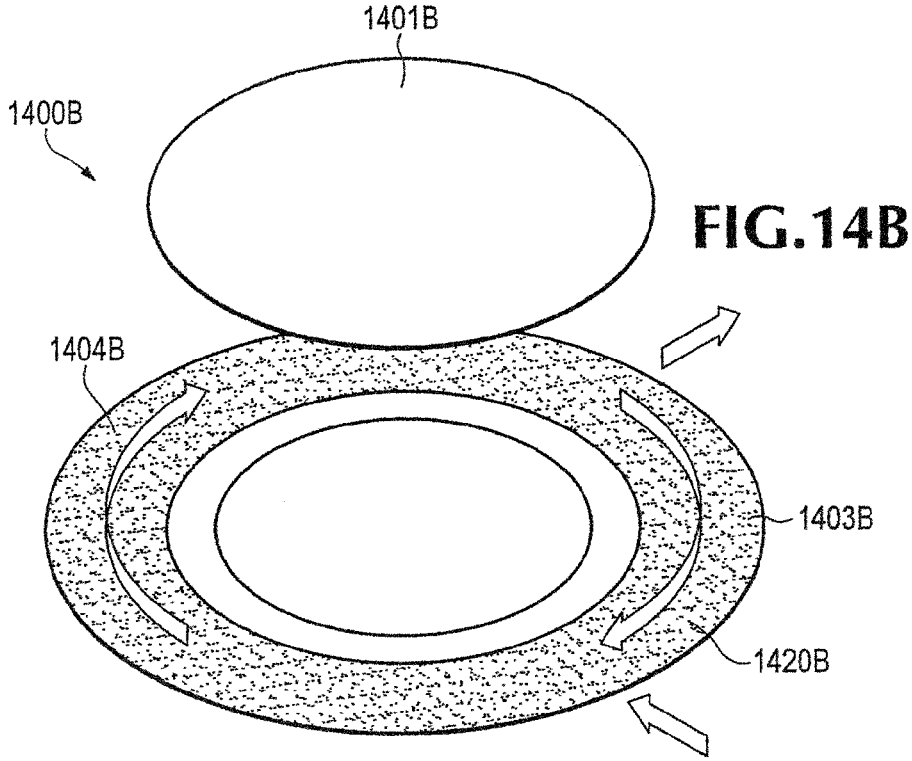
Figure 14C:
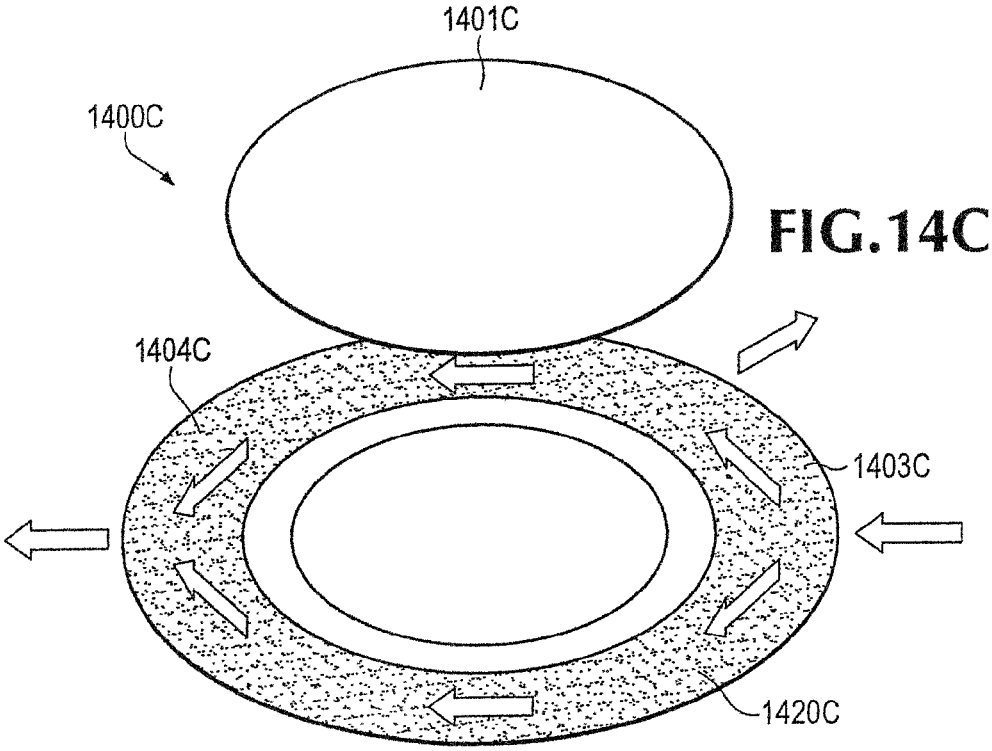

FIGS. 14A-C provide schematic diagrams of a polymeric substrate/surface comprising different zones for different polishing formulations.

Figure 15:
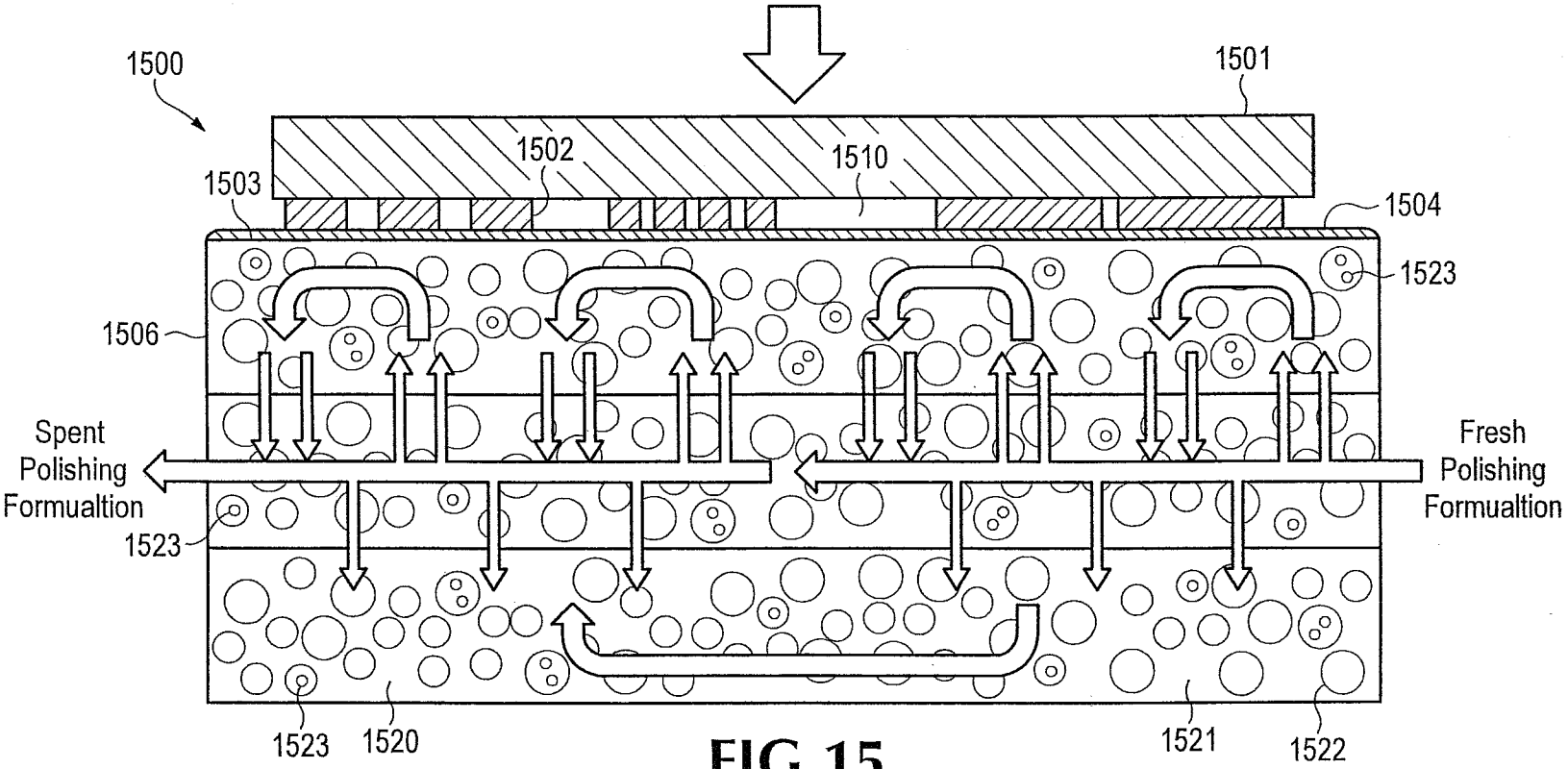

FIG. 15 provides a schematic diagram of a variation of a polishing apparatus, wherein the polishing apparatus comprises a porous polymeric substrate with polishing formulation therein.

Figure 16:
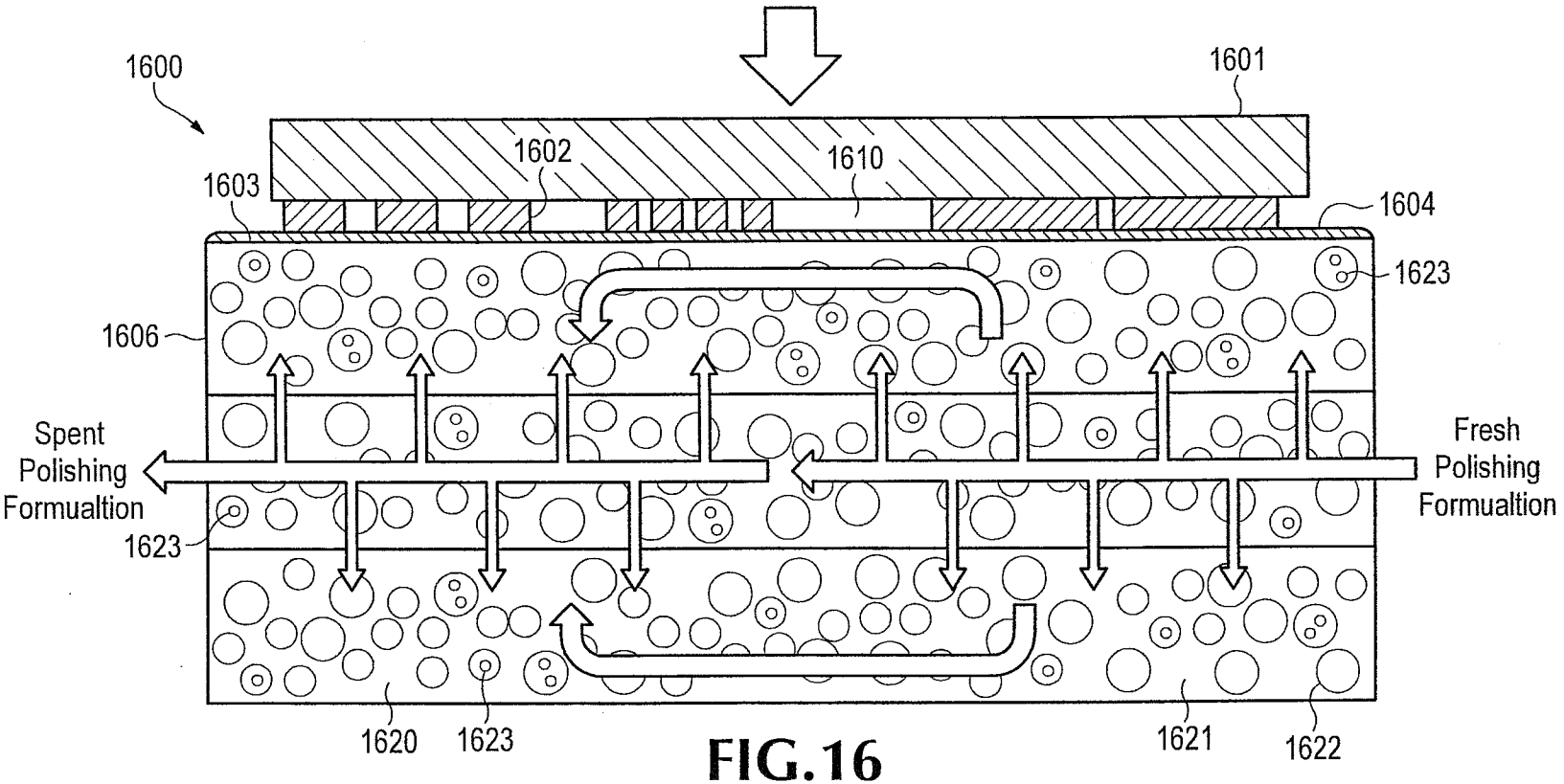

FIG. 16 provides a schematic diagram of a variation of a polishing apparatus, wherein the polishing apparatus comprises a hollow polymeric substrate with polishing formulation therein.

Figure 17:
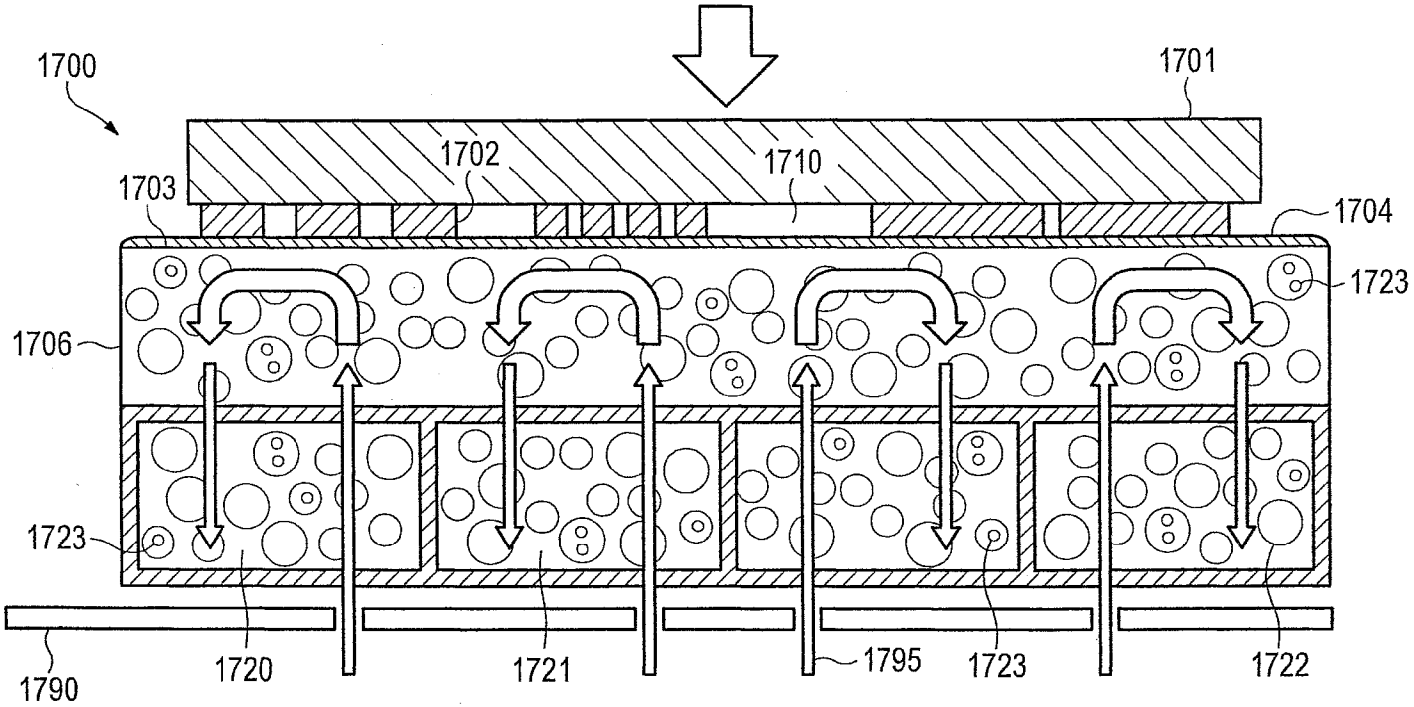

FIG. 17 provides a schematic diagram of a variation of a polishing apparatus, wherein the polishing apparatus comprises a hollow polymeric substrate with partitions and a distributor plate.

Figure 18:
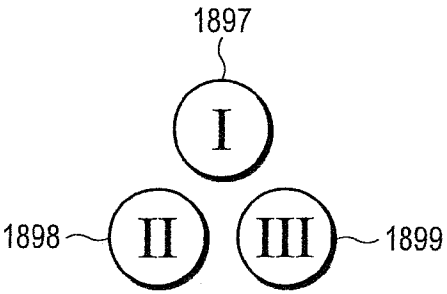

FIG. 18 provides a simplified schematic diagram of a variation of a polishing apparatus having multiple platens.

Figure 19:
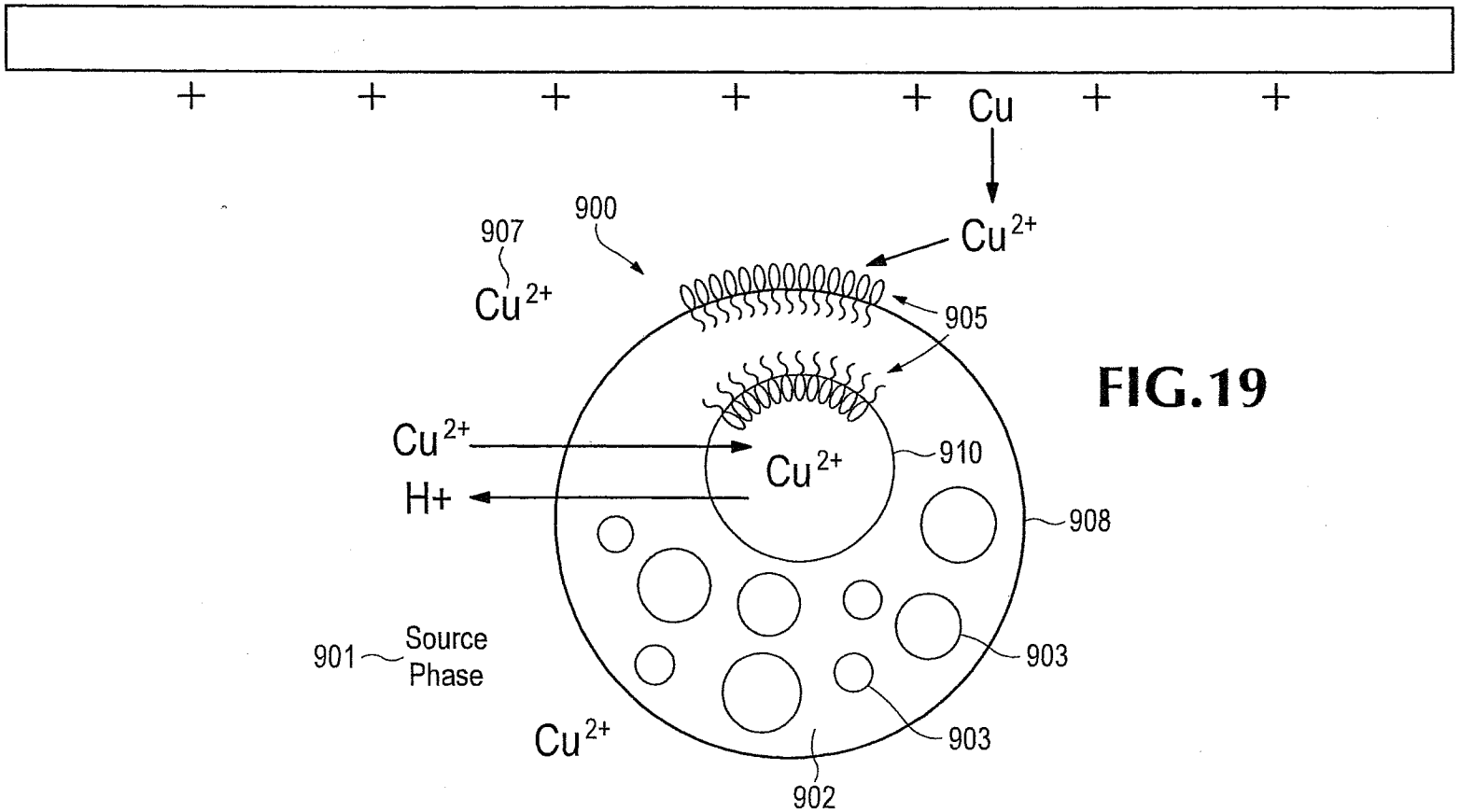

FIG. 19 provides another variation of a mechanistic scheme for the transport of metal cations through a polishing formulation in accordance with certain embodiments.

DETAILED DESCRIPTION

Described herein are apparatus, methods, and formulations for polishing a metallized surface of a substrate, e.g., a semiconductor wafer, that can be used with polishing formulations that are substantially, essentially, or entirely free of abrasives, and/or with zero or near-zero downforce applied against the substrate by a polishing pad. The apparatus, methods, and formulations described herein utilize chemical removal of metals or metal-containing species from a polishing substrate in a specialized and selective manner to ensure planarization of the substrate in both a global (i.e., over the surface of the entire polish substrate) and a local sense (i.e., over a small area of a particular pattern density). Thus, the apparatus, methods and formulations in general may not rely on mechanical frictional forces to polish the surface, which may result in improved flatness and/or improved polishing selectivity. Substrates with improved flatness may be used to build structures having very fine features, as for technology nodes lower than 90 nm, such as 65 nm, 45 nm, 32 nm, 22 nm, and smaller. Likewise, the apparatus, methods and formulations may be applicable to technologies with geometries scaled down even further. The invention is applicable to existing technologies in production for 90 nm and above, such as 250 nm technology nodes, or wherever CMP is used to planarize metal interconnects.

In general, the removal of the metals or metal-containing species from a polishing surface involves the oxidization of the species to be removed from the surface using a first aqueous solution, followed by complexation of the oxidized species to enter an organic or oil phase that may, in some instances, form an emulsion with the first aqueous solution. The complexed species may then transport the oxidized species to a second aqueous solution that is separated from the first aqueous solution. In certain variations, the second aqueous solution may be contained within the organic phase such that the organic phase functions as a liquid membrane separating the first and second aqueous solutions. Metal cation sequestration may take place at a polishing pad-polish substrate interface. In some variations, the sequestration process may take place at least partially within the bulk volume of a polymeric substrate rather than only at the interface of the surface of a polishing pad and a polish surface. The polishing apparatus, polishing formulations, and polishing methods described herein may provide finished and flat substrates (e.g., semiconductor wafers).

DEFINITIONS

The term "polish substrate," as used herein, refers to a substrate comprising a surface (a "polish surface") from which metal or metal-containing material is to be removed. A non-limiting example of a polish substrate is a semiconductor wafer, e.g., a wafer from which copper, cupric oxide, and/or cuprous oxide is to be removed.

The term "polishing apparatus," as used herein, refers to an apparatus comprising a polymeric substrate that comprises a polymeric surface that is configured to interface with a surface of a polish substrate. A polishing apparatus may comprise one or more additional features or components, for example, a polish substrate holder such as a wafer chuck for supporting and positioning a polish substrate, a mount or holder (e.g., platen) for a polymeric substrate, one or more delivery systems configured to deliver a polishing and/or rinse formulation to the polymeric substrate and/or polish substrate surface, and/or one or more motors (e.g., rotator) configured to cause relative motion (e.g., rotational, translational, orbital, or combinations thereof) between the polish substrate and the polymeric substrate. In addition, tool platforms may be rotary, linear, orbital, vertical, and/or inclined (at an angle between 0 and 90 deg).

The term "polishing formulation," as used herein, refers to any chemical solution that may be used in connection with removing metal or metal-containing material from a surface of a polish substrate. The term "metal-removing formulation" may be used interchangeably herein with "polishing formulation." In general, a polishing formulation described herein may contain an aqueous phase and an organic phase, which may or may not form an emulsion. Polishing formulations may comprise a complexing agent that is capable of complexing solvated metal cations and removing them from an aqueous phase or solution. The complexing agent may be contained within an organic or oil phase that is not generally miscible with water. In some variations, a polishing formulation may comprise a complexing agent-containing organic phase dispersed in a first aqueous phase, wherein the first aqueous phase is capable of oxidizing one or more surface metals or metal-containing species to form solvated cations. In certain variations, a polishing formulation may comprise a tri-phasic system: a first aqueous phase that is capable of forming solvated metal cations, an oil phase comprising a complexing agent that is capable of extracting the complexed cations from the first aqueous phase, and a second aqueous phase that is separated from the first aqueous phase by a liquid membrane (i.e., the organic/oil phase), wherein the second aqueous phase is capable of stripping the metal out of the oil phase.

The phrases, "substantially free of abrasive additives," "substantially free of abrasives," or the like, as used to describe polishing formulations of the invention, refer to polishing formulations in which a majority of metal or metal-containing species removal from a polish substrate is chemical and not mechanical (i.e., abrasion by small particles). Furthermore, a polishing formulation that is "substantially free of abrasives" has an insufficient amount of abrasive particles to impede the flow or circulation of the polishing formulation through the polishing apparatus, yet a small and detectable amount of polishing may occur because of the abrasive particles. A polishing formulation that is substantially free of abrasives generally will have less than about 1.0 weight percent particles in the slurry. The phrase, "essentially free of abrasives," or the like, is also used to refer to polishing formulations in which a majority of metal or metal-containing species removal from a polish substrate is chemical and not mechanical. A polishing formulation that is "essentially free of abrasives" has fewer abrasive particles than a polishing formulation that is "substantially free of abrasives," but a polishing formulation that is "essentially free of abrasives" is "not entirely free of abrasives." The concentration of abrasive particles in a polishing formulation that is "essentially free of abrasives" is not sufficiently high to provide polishing action on the substrate to be planarized. Generally a polishing formulation that is essentially free of abrasives has less than about 0.1% by weight particles in the slurry.

The term, "polymeric support structure," "polymeric substrate," or "polymeric matrix," as used herein, refers to a polishing apparatus component that has a body and a polymeric surface that is configured to interface with a polish surface of the polish substrate, e.g., a surface configured to support a thin liquid boundary layer (or latent boundary layer), that may comprise one or more phases of a polish formulation. In some variations, a polymeric substrate comprises a matrix or open pore network configured to support or hold one or more phases of a polishing formulation (e.g., an external aqueous phase comprising an oxidant, and/or an organic phase comprising a complexing agent) used in removing a metal or metal-containing species from a surface. For instance, a body of a polymeric substrate may be hollow or partially hollow, e.g., comprise a single hollow cavity, and/or an open network of pores. In another non-limiting example, a polymeric substrate may overlay a reservoir comprising one or more components of a polishing formulation.

The term "polymeric surface," as used herein refers to a polymeric surface that is configured to interface with a polish substrate. In general, a polymeric surface may be relatively hard or rigid, though not necessarily so, and may be permeable to one or more chemical species used in and/or produced during the chemical removal process. A polymeric surface in combination with a body forms a polymeric substrate as described above.

The term, "latent boundary layer," refers to polishing formulation (or a phase thereof) released from a polymeric surface saturated with polishing formulation when a small amount of downforce is applied to the polymeric surface. The amount of polishing formulation released may be proportional to the amount of downforce applied. In a non-limiting example, a polymeric surface saturated with a tri-phasic polishing formulation (e.g., a water-oil/organic-water emulsion) may release a latent boundary layer of polishing formulation when the polishing substrate is applied to the polymeric surface with a slight amount of downforce.

As used herein, the terms "external phase" and "external aqueous phase" refer to an aqueous phase that may be in contact with the polish substrate (e.g., semiconductor wafer). The external aqueous phase may oxidize metals or metal-containing species on the polish surface of the polish substrate and may dissolve the resulting metal cations. The external aqueous phase may also be referred to as a "first aqueous phase", a "donor phase" or a "feed phase."

As used herein, the term "liquid membrane," refers to an organic or oil phase that functions to separate two aqueous phases, e.g., a liquid membrane may be used to separate an external aqueous phase in contact with a polish substrate from a second aqueous phase that is not in contact with the polish substrate. A liquid membrane may comprise a bulk liquid membrane ("BLM"), an emulsion liquid membrane ("ELM"), a supported liquid membrane ("SLM") (e.g., a thin sheet supported liquid membrane or a hollow fiber supported liquid membrane), or combinations or variations thereof.

As used herein, the term "extract," and variants thereof, is used to describe removal of a particular species (e.g., metal cation) from one phase by another phase. In a non-limiting example, a metal species such as $Cu^{2+}$ may be removed from an aqueous phase by an organic phase comprising a complexing agent such as 5-dodecyl-2-hydroxybenzaldehyde oxime. It is understood by a person having ordinary skill in the art that additional agents need not be present to cause extraction, as certain species may inherently distribute between two different phases. Continuing with the non-limiting example, the complexed metal species in the organic phase may be removed or extracted from the organic phase by a second aqueous phase. In this case, the second aqueous phase is said to "strip" the metal species from the organic phase. Fundamentally, there is no distinction between the "extracting" and "stripping" processes as used and/or described herein. Both processes involve the removal of a particular species from one phase by another phase. It is a matter of convenience that the term "strip," (and variants thereof) is used to describe a second extraction, if one takes place, in a polishing formulation of the invention.

As used herein, the terms "internal phase" and "internal aqueous phase" refer to an aqueous phase in contact with a liquid membrane, but not in direct contact with a polish substrate (e.g., a semiconductor wafer). For example, in some variations, solvated metal cations of an external phase in contact with a polish substrate may permeate through a liquid membrane and, ultimately, into an internal aqueous phase. An internal aqueous phase may also be referred to herein as a "second aqueous phase," a "receiving phase," a "receptor phase," or a "stripping phase."

The term "primary emulsion," as used herein, generally refers to a first-prepared emulsion of a water-oil-water ("W/O/W") emulsion. A primary emulsion may be characterized as water or an aqueous solution dispersed within an organic solvent or an organic solution. The term "secondary emulsion," as used herein, generally refers to a second-prepared emulsion of a W/O/W emulsion. The secondary emulsion may be characterized as a primary emulsion dispersed within water or an aqueous solution. The aqueous phase of a secondary emulsion is the external aqueous phase in a final W/O/W emulsion, and a primary emulsion in a final W/O/W emulsion, as above, comprises the liquid membrane and the internal aqueous phase.

The term "liquid membrane system" is a generic term for any one of the following liquid membrane systems: bulk liquid membrane ("BLM") system, emulsion liquid membrane ("ELM") system (e.g., W/O/W emulsion system), or immobilized/supported liquid membrane ("ILM" or "SLM") system (e.g., systems wherein the liquid membrane is supported by a thin sheet, a hollow fiber, or two hollow fibers), or combinations or variations thereof. A liquid membrane system of the invention is generally characterized as having at least one liquid membrane.

The term "nanoscale" means on a scale of about $1\times10^{-9}$ meter; that is to say, having or involving dimensions in a range 1 to 1000 nanometers.

The term "microscale" means on a scale of about $1\times10^{-6}$ meter; that is to say, having or involving dimensions in a range 1 to 1000 micrometers (microns).

The following sections describe polishing apparatus, methods, and formulations for polishing a metallized surface of a substrate (e.g., a semi-conductor wafer). In the section that immediately follows, general features of the polishing apparatus are given along with certain embodiments described in accordance with the figures. This section is followed by a description of polymeric substrates, which also includes certain embodiments described in accordance with the figures. Next, the polymeric surface is described followed by a discussion of properties and materials that are, in many cases, shared between the polymeric substrate and the polymeric surface. Finally, polishing formulations and methods of the invention are described.

In general, polishing apparatus are configured for removing metal and/or metal-containing species from a metallized surface of a polish substrate to form a polished surface. Polishing apparatus of the invention generally comprise a polish substrate holder (e.g., wafer chuck) configured to support the polish substrate, one or more platens, and a polymeric substrate configured to support a polishing formulation, the polymeric substrate comprising an external polymeric surface which interfaces with the metallized surface. The polymeric surface may either support a boundary layer of polishing formulation, or the polymeric surface may be saturated with polishing formulation such that the slightest amount of downforce allows for the release of a proportionate amount of polishing formulation that may flood or partially flood the polymeric surface. In any of these scenarios, the polymeric surface is in fluid communication with the polymeric substrate and polishing formulation freely moves between the polymeric substrate and the polymeric surface. The polishing formulation of the invention may be a bi-phasic system comprising, for example, an organic solution dispersed within an aqueous solution. The polishing formulation may be a tri-phasic system, wherein the organic solution, for example, further comprises an aqueous solution dispersed within it (e.g., W/O/W emulsion). The constituents of either one of the bi-phasic emulsion or tri-phasic emulsion may be used separately instead of being emulsified. More detail on polishing formulations and polishing apparatus components, including auxiliary de/emulsification equipment, is provided below. A person having ordinary skill in the art will appreciate, given the description below, that any of the polishing formulations of the invention are suitable for use with any of the polishing apparatus of the invention.

Polishing Apparatus

In general terms, a polishing apparatus may comprise a polymeric substrate comprising a polymeric surface that is configured to interface with a metallized surface of a polish substrate. The polymeric substrate may or may not be moved (e.g., in a rotational, linear, or orbiting movement, or in a combination thereof) relative to the polish substrate. A polymeric surface of a polymeric substrate opposing the metallized surface may function to support a thin boundary layer (or latent boundary layer) of a solution, that in some instances may comprise one or more phases of a polishing formulation, e.g., an external aqueous phase that can oxidize and solvate one or more metals or metal-containing species from the surface of the polish substrate. In some variations, a polymeric substrate may comprise a three-dimensional structure or matrix that is configured to support one or more formulations used in a chemical removal process, e.g., a two phase or a three phase emulsion dispersed throughout the matrix. In some variations, a polymeric substrate comprises a frame, mount, or the like, that provides a mechanical framework for the polymeric substrate, while in other instances, a polymeric substrate may be used without such a mechanical framework, e.g., by virtue of the rigidity and/or shape of the polymeric substrate.

As described above, the polymeric substrate comprises a polymeric surface configured to interface with a metallized surface of a polish substrate. The polish substrate may interface with a polymeric surface of a polymeric substrate with, for example, little (e.g., <1 psi) or about zero downforce (e.g., suspended above). In addition, a boundary layer (or latent boundary layer), which may comprise one or more phases of a polishing formulation may be in contact with the metallized surface at the interface between the polymeric surface and the polish substrate. In some variations, the boundary layer (or latent boundary layer) may comprise an aqueous solution that can oxidize the metallized surface to form solvated cations. Such an aqueous solution may comprise an aqueous phase of a multi-phase polishing formulation. As described above, the polishing formulation comprises a liquid that comprises one or more chemical species needed to effect removal of the desired metal species. Without limitation, the metals that may be removed from a metal or metal-containing surface of a polish substrate include aluminum, antimony, arsenic, bismuth, cadmium, chromium, copper, cobalt, gallium, gold, hafnium, indium, iridium, iron, lead, manganese, mercury, molybdenum, neodymium, nickel, niobium, osmium, palladium, platinum, rhenium, rhodium, ruthenium, selenium, silver, tantalum, tellurium, thallium, thorium, tin, tungsten, uranium, vanadium, titanium, zinc, zirconium, and/or rare earth metals. Alloys of the above metals and other metal-containing materials such as metal oxides, metal nitrides, metal carbides, metal sulfides, and the like, may also be removed from metal-containing surfaces.

With reference to FIG. 1, a general schematic of one example of a polishing apparatus is shown. There, the polishing apparatus (100) comprises a polish substrate holder (not shown) that places a metallized surface (111) of a polish substrate (101) generally parallel to and opposing (e.g., with near-zero downforce) a polymeric surface (103) of a polymeric substrate (106) during polishing. The metallized surface (111) comprises topographical features or protrusions (102) separated by recesses (110). The polymeric surface (103) may be hard or rigid. As indicated by arrows (108), one or more phases of a polishing formulation (104), e.g., an aqueous phase that is capable of oxidizing metals or metal-containing species, may permeate the polymeric surface (103) of the polymeric substrate (106) to form a thin boundary layer, latent boundary layer, or partial layer (112) that makes local contact with the protrusions (102), but does not contact recesses (110). A polishing formulation (104) generally comprises a complexing agent for complexing metal cations. The complexing agent may be contained within an organic phase that is not generally miscible with water. Thus, metal cations at or near the surface of protrusions (102) may be complexed and/solvated. In some variations, a boundary layer (112) may not permeate up through the polymeric substrate (106), but may be applied directly to the polymeric surface (103). Because the polymeric surface (103) may be hard or rigid, the boundary layer (112) may preferentially contact the tallest protrusions (102), causing those protrusions to be polished first. Thus, the polymeric surface (103) may provide controllable removal of protrusions (102) from a surface (111) without the need for abrasives or mechanical polishing. The rate and/or degree of removal of metals and metal-containing species from a metallized surface may be controlled by the flow and/or the chemical composition of a polishing formulation that is delivered through a polymeric substrate/surface. By keeping a hard or rigid polymeric surface generally parallel to and near or against the polish substrate, surface protrusions of the polish substrate may be controllably removed to achieve a desired local and global flatness of the metallized surface. Lateral movement of the polymeric substrate relative to the polish substrate may not be generally needed. And, as such, surface defects such as dishing and erosion may be reduced or substantially eliminated.

Again, in reference to FIG. 1, the polishing process commences with the placement of polish substrate (101) (e.g., blanket wafer, patterned wafer, semiconductor wafer) on (e.g., with near-zero downforce) or near primed (i.e., surface and pores saturated with fresh polishing formulation 104) polymeric surface (103). The polish substrate (101) and/or the polymeric surface (103) of the polymeric substrate (106) may each be held stationary or one or the other, or both, may be moved (e.g., linearly, orbitally, rotatably, and the like) or oscillated toward and away from one another, as long as the tallest portions (i.e., areas to be polished, for example, protrusions (102)) of the polish substrate (101) are in sufficient contact with the boundary layer (112) on the polymeric surface (103). In a non-limiting example of copper removal from a semiconductor wafer, an aqueous solution (not shown) oxidizes and dissolves copper and copper-containing species. The resulting solvated copper (e.g., $Cu^{1+}$, $Cu^{2+}$), driven by, for example, a concentration or pH gradient, permeates into the organic phase of polishing formulation (104), where it is complexed and concentrated, the organic phase functioning as a metal ion repository (or a transport medium in some variations). The metallized surface (111) of the polish substrate (101) may remain in contact with the boundary layer (112) as long as necessary to effect removal of a desired amount of material. Should the polishing formulation (104) become saturated with the metal species being removed, spent polishing formulation may be discharged through an outlet (not shown) below the polymeric surface (103), and fresh polishing formulation (104) may be introduced through an inlet (not shown).

As stated above, in general, the polishing formulation may comprise an oxidizing external aqueous phase to dissolve metal or metal-containing species from the protrusions on the polish substrate. In addition, the polishing formulation may comprise a complexing agent that complexes solvated metal cations. In these variations, the complexing agent may be in an organic or oil phase dispersed within the external aqueous solution. Thus, the organic phase may function to extract solvated metal cations out of the external aqueous phase, which may, in turn, drive the external aqueous phase to dissolve additional metal and metal-containing species from the surface being polished. In certain variations, the organic phase may comprise within it a second aqueous phase (an internal aqueous phase) that functions to strip the metal complex of the organic phase of its metal, thereby dissolving the metal cations in the second internal aqueous phase. In this variation, the internal aqueous phase is separated from the external aqueous phase by the organic phase, which functions as a liquid membrane between the two aqueous phases.

Referring now to FIG. 2, another general polishing apparatus is shown. There, polishing apparatus (200) comprises a polish substrate holder (not shown) holding a metallized surface (211) of a polish substrate (201) against a hard or rigid polymeric surface (203) of a polymeric substrate (206). The metallized surface (211) comprises surface protrusions or features (202), the tallest of which may abut the polymeric surface (203), which may be porous. In this particular variation, the polymeric substrate (206) comprises an open matrix or pathway of open pores through which a polishing formulation (221) is dispersed. A thin, latent, or partial boundary layer (204) may be formed on polymeric surface (203) to contact protrusions (202), but is generally not in contact with recesses (210) that separate protrusions (202). For example, one or more components of the polishing formulation (221) may permeate polymeric surface (203) to contact protrusions (202). The boundary layer (204) may comprise an aqueous solution capable of oxidizing metals or metal-containing species on the metallized surface (211) and solvating the resulting metal cations. The polishing formulation (221) may be any suitable polishing formulation, but in this particular example, the polishing formulation (221) comprises an aqueous external phase (220) that solvates metal cations. In some variations, the external aqueous phase (220) may also oxidize one or more metals or metal-containing species in the protrusions (202). Thus, the boundary layer (204) may comprise, or be in fluid contact with, the external aqueous phase. The polishing formulation (221) also comprises an oil or organic phase (222) dispersed within the external aqueous phase (220). The size and distribution of the droplets of the oil phase particles (222) within the external aqueous phase (220) may be varied to give a larger or smaller droplet surface area depending, for example, on a desired rate of metal extraction. The metal may be subsequently recovered from the organic phase (220), as will be discussed in greater detail below.

Another general polishing apparatus is shown in FIG. 3. There, polishing apparatus (300) comprises a polish substrate holder (not shown) positioning a metallized surface (311) of a polish substrate (301) against a polymeric substrate (306), for example, with little or about zero downforce. The polymeric substrate (306) comprises a hard or rigid polymeric surface (303) that interfaces with the polish substrate (301). The metallized surface (311) comprises protrusions (302) separated by recesses (310). The tallest protrusions (302) may abut the polymeric surface (303). The polymeric substrate (306) comprises an open pore network or matrix throughout which a polishing formulation (321) is distributed. A thin, latent, or partial boundary layer (304) contacts protrusions (302), but not recesses (310). For example, one or more components of the polishing formulation (321) may permeate through the polymeric surface (303) to form the boundary layer (304). The boundary layer (304) may comprise an aqueous solution that oxidizes metals or metal-containing species from the metallized surface (311) and solvates the resulting metal cations. In this particular variation, the polishing formulation (321) comprises a water-oil-water ("W/O/W") emulsion. That is, the polishing formulation (321) comprises an external aqueous phase (320), which may or may not contain a complexing agent, which can solvate metal cations. The boundary layer (304) may comprise, or be in fluid contact with, the external aqueous phase (320). Thus, in certain variations, the external aqueous phase (320) may also function to oxidize a metal or metal-containing species from protrusions (302) to form solvated cations. An organic phase (322) is dispersed within the external aqueous phase (320), and the organic phase (322) contains a complexing agent for the solvated metal cations of the external aqueous phase (320). Similar to the polishing apparatus shown in FIG. 2, the organic phase (322) extracts the solvated metal cations from the external aqueous phase (320). The size and distribution of the droplets of the organic phase (322) within the external aqueous phase may be varied to give a larger or smaller droplet surface area depending on the desired rate of metal extraction. In this particular example, the organic phase (322) comprises within it a dispersion of an internal aqueous phase (323). The internal aqueous phase may strip the metal cation from the metal complex of the organic phase (322). The metal may be subsequently recovered from the internal aqueous phase (323). The boundary layer (304) between the surface of the polymeric substrate (306) and the surface of the polish substrate (301) may also comprise the organic phase (322) along with the internal aqueous phase (323); that is to say, the boundary layer (304) is not limited to being the external aqueous phase (320) of a W/O/W emulsion, but may be a thin boundary layer (or latent boundary layer) (304) of W/O/W emulsion having permeated through the pore structure (being of adequate size and distribution) of the polymeric substrate (306).

The polishing apparatus of the invention may be used alone or in combination with additional polishing apparatus. The additional polishing apparatus may or may not be a polishing apparatus of the invention. By design, a polishing apparatus of the invention may use a number of different polishing formulations, diluents, rinses, or any combinations thereof, to effect removal of a particular material, or to effect a certain removal rate of a particular material. Different polishing formulations may be used in succession, or using zones or channels (described below), or additional platens, different polishing formulation may be used simultaneously in a single polishing apparatus. In a non-limiting example, copper and copper-containing materials may be removed from a polish substrate with a copper-removing polishing formulation of a chosen strength (which may be attenuated as desired), and later, tantalum and tantalum-containing materials may be removed with a tantalum-removing polishing formulation. This non-limiting example is further exemplified in FIG. 18. Referring to FIG. 18, the bulk (~80%) of copper or copper-containing species that is to be removed may be removed from a polish substrate using a first polishing formulation on a first platen (1897). The remaining (~20%) copper or copper-containing species that is to be removed may be removed using a second polishing formulation on a second platen (1898). If a metal or a metal-containing species such as tantalum is to be removed, a third polishing formulation and a third platen (1899) may be used for that removal process. In an alternative embodiment, the first and second polishing formulations may each be used in succession on a single platen. In a three-platen polishing apparatus like that shown in FIG. 18, the first and second platens (1897 and 1898) may each be used to remove the bulk of copper or copper-containing species with a first polishing formulation, and subsequent to an optional rinse, the remaining copper or copper-containing species may be removed from the polish substrate with a second polishing formulation. Each polish substrate, when ready, may then be moved to the third platen to remove, for examples, tantalum. An advantage to using different polishing formulations with a single polishing apparatus (optionally, with two or more platens) is that it may be cost effective in terms of capital.

Polishing apparatus in combination may act as polishing stations in which, for example, different materials are removed at each polishing station. This may not be advantageous in terms of capital, but combinations of polishing apparatus may be effective in terms of saving time. In a non-limiting example, copper may removed from a copper-and-tantalum-containing polish substrate using a polishing apparatus configured for removing copper. Subsequently, tantalum may be removed from the copper-and-tantalum-containing polish substrate using a different polishing apparatus configured for removing tantalum. A common CMP polishing apparatus may also be used in combination with a polishing apparatus of the invention. In a non-limiting example, a common CMP polishing apparatus is used in a preliminary or course-grade copper removal process and a polishing apparatus of the invention is used to refine the flatness and finish of the final polish substrate.

The polishing apparatus may be supplemented with processing equipment for chemical handling (e.g., formulation; mixing, such as emulsification; de-emulsification; separation; and purification), some of which may be part of a closed loop, providing an environmentally-friendly solution to current practices in CMP. Examples of processing equipment and procedures are disclosed in U.S. Pat. No. 6,458,289, which is hereby incorporated by reference in its entirety. On the supply side of the loop, polishing formulations may be created from reserves and, in the case of emulsified polishing formulations, may be emulsified on site using emulsification units. The polishing formulation may then used to polish a metallized surface of a polish substrate as described herein. As spent polishing formulation (emulsion) exits the polymeric substrate, de-emulsification units (e.g., sonicators, ultrasonicators) may be used to break the emulsion (e.g., a W/O/W emulsion) and create bulk aqueous and organic phases. The solvent of each respective phase may be stripped off the contaminant species (e.g., metals, surfactants, complexing agents, and the like) and purified for re-use in the emulsification loop. Other chemicals may be recovered and re-used as well. As above, closed loop recycling of the solvents makes for an environmentally-friendly solution to CMP. The process/methodology of the invention may substantially reduce solvent inventory requirements and eliminate the need for vast slurry reserves and distribution systems. In addition, issues related to slurry storage, mixing, settling, and clogging of the lines may be resolved.

Having described the general features of the polishing apparatus, and having shown non-limiting examples of polishing apparatus in FIGS. 1-3, the components of a polishing apparatus will be described in more detail below, e.g., the polymeric substrates, the polymeric surface, as well as polishing formulations, and additional components.

Polymeric Substrates

The polymeric substrate and its corresponding polymeric surface may have a wide variety of configurations and properties. In certain variations, a polymeric substrate may comprise an open pore network or matrix that has a surface to interface with the polish substrate, similar to polymeric substrates (206) and (306) illustrated in FIGS. 2 and 3, respectively.

In other variations, the polymeric substrate may comprise a porous polymeric sheet supported on or over a reservoir comprising a polishing formulation or overlaying a dynamic dispense of the polishing formulation. Referring now to FIG. 4, a polishing apparatus (400) is illustrated. There, a metallized surface of the polish substrate (401) having protrusions (402) may be placed near or against a porous flat surface (403) of a polymeric substrate (406), for example, using little or near zero downforce. One or more components of a polishing formulation (420) contained in a reservoir (450) below the polymeric substrate (406) may permeate through the polymeric substrate (403) to form a thin boundary layer (or latent boundary layer) (404) of polishing formulation (420) on polymeric surface (403) as described above in connection with FIGS. 1-3.

In certain variations, a polishing apparatus may comprise a polymeric substrate that comprises a combination of components. For example, a polymeric substrate may comprise a top component that comprises a surface configured to interface with a polish substrate, and a matrix component that comprises an open pore network that is configured to hold or support one or more phases of a polishing formulation. Referring now to FIG. 5, a variation of a polishing apparatus (500) comprises a polish substrate holder (not shown) to hold a metallized surface (511) of a polish substrate (501) having protrusions (502) against a polymeric surface (503) (e.g., a porous polymeric surface) of a top component (508) of polymeric substrate (506). The polymeric substrate (506) also comprises a matrix component (510) comprising an open network of pores throughout which one or more phases of a polishing formulation (520) are distributed. The matrix component (510) is in fluid communication with the top component (508); thus, one or more phases of polishing formulation (520) supported in matrix component (510) may permeate through a porous top component (508) to contact with the polish substrate (501), or a fluid on the surface (503) may diffuse down through top component (508) to reach the matrix component (510). The matrix component (510) may have any suitable external configuration (e.g., planar, cylindrical, bundles of hollow fibers, and the like) and any suitable internal configuration of open pores to hold or support one or more phases of a polishing formulation (520).

In certain instances, a polymeric substrate may comprise a hollow but rigid body and a top portion comprising a polymeric surface that interfaces with a metallized surface of a polish substrate. Referring now to FIG. 6, a variation of a polishing apparatus (600) comprises a polish substrate holder (not shown) configured to position protrusions (602) of polish substrate (601) against the polymeric surface (603) of a top portion (605) of a hollow polymeric substrate (606). A polishing formulation (620) is contained within a cavity (607) of the hollow substrate (606). The top portion (605) may be porous so that one or more components of the polishing formulation (620) may permeate therethrough, for example, to diffuse down into the body, or to form a thin, latent, or partial boundary layer (604) of polishing formulation (620) on the surface (603) to contact and to selectively remove metal or metal-containing species from protrusions (602).

In certain variations, a polymeric substrate may be a hollow but rigid polymeric substrate with a polymeric surface that interfaces with a metallized surface of a polish substrate. Referring now to FIG. 7, a variation of a polishing apparatus (700) comprises a polish substrate holder (not shown) configured to position protrusions (702) of polish substrate (701) against the polymeric surface (703) of a hollow polymeric substrate (706). Different phases of a polishing formulation may be contained within cavity (707*a/b*) of hollow substrate (706): Source/external aqueous phase (704) fills source phase cavity (707*a*) of hollow substrate (706); receiving/internal phase (705) fills receiving phase cavity (707*b*); and the organic phase (750) impregnates the porous liquid membrane support structure (709). The polymeric surface (703) may be porous so that the source/external phase (704) of the polishing formulation may permeate therethrough to form a thin, latent, or partial boundary layer (708) on the surface (703) to contact and to remove metal and/or metal-containing species from protrusions (703), but not recesses (710).

Referring now to FIG. 8, another variation of a polishing apparatus is shown. There, a polishing apparatus (800) comprises a polish substrate holder (not shown) configured to position metallic protrusions (802) of a polish substrate (801) against the polymeric surface (803) of a hollow polymeric substrate (806). Different phases of a polishing formulation may be contained within cavity (807) of hollow substrate (806): Source/external phase (804) fills the cavity (807) of hollow substrate (806); receiving/internal phase (805) fills the inner portion of hollow fiber (809); and the organic phase (850) impregnates the porous walls of hollow fiber (809). The polymeric surface (803) may be porous so that the source/external phase (804) of the polishing formulation may permeate therethrough to form a thin, latent, or partial boundary layer (808) on the surface (803) to contact and to remove metal and/or metal-containing species from protrusions (802), but not recesses (810).

Referring now to FIG. 11, another variation of a polishing apparatus is shown. In this variation, the polishing apparatus (1100) comprises a belt-type polymeric substrate (1106) that is fitted across at least two rollers, which move as indicated by the arrows. The polymeric substrate (1106) comprises a polymeric surface (1103), upon which polish substrates (1101) interface with a boundary layer (1104) of polishing formulation (1120). The polishing formulation (1120) may be dispensed from, for example, a reservoir (1150) such as that shown in FIG. 11; however, other methods of distribution are possible as recognized by a person having ordinary skill in the art. Additional reservoirs (1150) (e.g., those shown in outline/shadow in FIG. 11) comprising the same or different polishing formulations may be configured to deliver polishing formulations in longitudinal zones. Even though FIG. 9. depicts three zones, additional reservoirs may be added to increase the number of zones. Depending on the polish substrate, zones may be useful in adjusting which metals and/or metal-containing species are removed. In addition, zones may be useful in adjusting the rate at which certain metals and/or metal-containing species are removed. Moving the polish substrate laterally from longitudinal zone to longitudinal zone is one method in which different zones may be used to change the characteristics of the polish process. Polishing apparatus (1100) may further comprise a reservoir (1180) for dispensing rinse formulation (1170) (e.g., deionized water). Since the pad is continuously being cycled for reuse, it is important to rinse the polymeric surface (1103) of spent polishing formulation and prepare it for fresh polishing formulation (1120).

Another variation of a polishing apparatus is shown in FIG. 12. In this variation, the polishing apparatus (1200) may be a belt-type polishing apparatus like that shown in FIG. 11 or any other polymeric substrate (1206) comprising two spaced polymeric surfaces (1203A and 1203B) positioned vertically or at some chosen angle. As shown, polish substrates (1201A and 1201B) interface with their respective polymeric surfaces (1203A and 1203B), both of which are wetted with polishing formulation (1220) dispensed from reservoirs (1250). As in FIG. 11, the spotted longitudinal arrows indicate a boundary layer (1204) and the general direction in which the polishing formulation (1220) is traverses the polymeric surface (1203A/B). Furthermore, the presence of three reservoirs (1250) indicates the presence of polishing zones, which, in this case, are demarcated with dashed lines. As above, reservoirs (1250) may be configured to deliver different polishing formulations, which may be useful in adjusting which metals and/or metal-containing species are removed, as well as the rate at which those metallic species are removed.

FIG. 13 depicts yet another version of a polishing apparatus of the invention. In this version, polishing apparatus (1300) comprises a roller-type polymeric substrate (1306) comprising a polymeric surface (1303). As with some other polishing apparatus of the invention that incorporate relative movement between the polymeric substrate/surface and the polish substrate, roller-type polymeric substrate (1306) may move across the surface of the polish substrate (1301) in the direction shown by the curved arrow. The polishing formulation (1320) is delivered from a reservoir (1350) and into or onto the polymeric substrate (1306) to form a boundary layer (1304) of polishing formulation (1320). In one variation of polishing apparatus (1300), the polishing formulation (1320) is delivered into the polymeric substrate (1306) and, ultimately, permeates from the inside of polymeric substrate (1306) to the external surface of the polymeric substrate (i.e., polymeric surface (1303)). In other variations, the polishing formulation (1320) is applied directly to the polymeric surface (1303). As with other embodiments of the invention, polishing zones may be created by delivering different polishing formulations to different sections of the polymeric surface.

Another variation of a polishing apparatus is shown in FIG. 15. As in other variations, polishing apparatus (1500) comprises a polish substrate holder (not shown) positioning a polish substrate (1501) against a hard or rigid polymeric surface (1503) of a polymeric substrate (1506) with, for example, little or about zero downforce. Furthermore, the polymeric surface (1503) is configured to support a thin, latent, or partial boundary layer (1504) designed to contact protrusions (1502) of the polish substrate, but not recesses (1510). In the variation shown in FIG. 15, the polymeric substrate (1506) comprises an open pore network or matrix throughout which a polishing formulation (1520) is distributed. Any fresh polishing formulation (1520) of the invention (e.g., W/O/W emulsion) may be introduced to the polymeric substrate (1506) by means of an inlet and spent polishing formulation may be discharged by means of an outlet. Arrows are used in FIG. 15 to show how polishing formulation (1520) may move within the polish substrate (1506). For example, fresh polishing formulation (1520), or one or more components of the polishing formulation (1520) (e.g., external aqueous phase (1521), a primary emulsion comprising internal aqueous phase (1523) and organic phase (1522) of a W/O/W emulsion, or a complete W/O/W emulsion) may be introduced to the polymeric substrate (1506) through an inlet. The polishing formulation (1520) or a component thereof, may then permeate to the top, bottom, or top and bottom of the polymeric substrate (1506). Polishing formulation that permeates to the top of the polymeric substrate (1506) may permeate through the polymeric surface (1503) to form the boundary layer (1504). Spent polishing formulation may then permeate back through the polymeric surface (1503) and into the polymeric substrate (1506) where it may ultimately exit through an outlet. The polishing formulation in FIG. 15 is not limited to W/O/W emulsions. As such, any polishing formulation described herein may be used in the polishing apparatus of FIG. 15.

FIG. 16 provides another variation of a polishing apparatus of the invention. As in other variations, polishing apparatus (1600) comprises a polish substrate holder (not shown) positioning a polish substrate (1601) against a hard or rigid polymeric surface (1603) of a polymeric substrate (1606) with, for example, little or about zero downforce. Furthermore, the polymeric surface (1603) is configured to support a thin, latent, or partial boundary layer (1604) designed to contact protrusions (1602) of the polish substrate, but not recesses (1610). In the variation shown in FIG. 16, the polymeric substrate (1606) comprises an hollow cavity throughout which a polishing formulation (1620) is distributed. Any fresh polishing formulation (1620) of the invention (e.g., W/O/W emulsion) may be introduced to the polymeric substrate (1606) by means of an inlet and spent polishing formulation may be discharged by means of an outlet. Arrows are used in FIG. 16 to show how polishing formulation (1620) may move within the polish substrate (1606). For example, fresh polishing formulation (1620), or one or more components of the polishing formulation (1620) (e.g., external aqueous phase (1621), a primary emulsion comprising internal aqueous phase (1623) and organic phase (1622) of a W/O/W emulsion, or a complete W/O/W emulsion) may be introduced to the polymeric substrate (1606) through an inlet. The polishing formulation (1620) or a component thereof, may then permeate to the top, bottom, or top and bottom of the polymeric substrate (1606). Polishing formulation that permeates to the top of the polymeric substrate (1606) may permeate through the polymeric surface (1603) to form the boundary layer (1604). Spent polishing formulation may then permeate back through the polymeric surface (1603) and into the polymeric substrate (1606) where it may ultimately exit through an outlet. The polishing formulation in FIG. 16 is not limited to W/O/W emulsions. As such, any polishing formulation described herein may be used in the polishing apparatus of FIG. 16.

Another variation of a polishing apparatus of the invention is provided in FIG. 17. As in other variations, polishing apparatus (1700) comprises a polish substrate holder (not shown) positioning a polish substrate (1701) against a hard or rigid polymeric surface (1703) of a polymeric substrate (1706) with, for example, little or about zero downforce. Furthermore, the polymeric surface (1703) is configured to support a thin, latent, or partial boundary layer (1704) designed to contact protrusions (1702) of the polish substrate, but not recesses (1710). In the variation shown in FIG. 17, the polymeric substrate (1706) comprises a hollow cavity partitioned by partitions (1795) to hold one or more polishing formulations or rinses. As shown, polymeric substrate (1706) is partitioned into three chambers or zones, each of which may contain the same or a different polishing formulation of rinse. (See FIG. 14A for an additional representation of the polishing apparatus.) A person having ordinary skill in the art will recognize that a polymeric substrate, depending on the polish substrate and polishing application, may be partitioned into any number of suitable zones throughout which polishing formulation or rinse may be distributed. Any fresh polishing formulation (1720) of the invention (e.g., W/O/W emulsion) may be introduced to the polymeric substrate (1706) by means of a distributor plate (1790) and spent polishing formulation may be discharged from the polymeric substrate (1706) by, for example, periodically rinsing the polymeric surface (1703) of spent polish formulation. Arrows are used in FIG. 17 to show how polishing formulation (1720) may move within the polish substrate (1706). For example, fresh polishing formulation (1720), or one or more components of the polishing formulation (1720) (e.g., external aqueous phase (1721), a primary emulsion comprising internal aqueous phase (1723) and organic phase (1722) of a W/O/W emulsion, or a complete W/O/W emulsion) may be introduced to the polymeric substrate (1706) through a distributor plate (1790). The polishing formulation (1720) or a component thereof, may then permeate to the top of the polymeric substrate (1706) and, ultimately, through the polymeric surface (1703) to form the boundary layer (1704). Spent polishing formulation may then be rinsed from the polymeric surface (1703), collected, and processed (e.g., demulsification followed by metal recovery). The polishing formulation in FIG. 17 is not limited to W/O/W emulsions. As such, any polishing formulation described herein may be used in the polishing apparatus of FIG. 17.

For any configuration of polymeric substrate and corresponding polymeric surface, the polishing formulation may comprise any suitable polishing formulation, but in general may comprise a complexing agent within an organic phase that can function to extract a solvated metal cation from aqueous solution. Thus, the polishing formulations used in connection with polishing apparatus (400), (500), (600), (700), (800), (1100), (1200), (1300), (1500), (1600), or (1700) shown in FIGS. 4, 5, 6, 7, 8, 11, 12, and 13 respectively, and variations thereof, may each comprise a polishing solution as described in connection with FIG. 1, 2, or 3 above.

The polymeric substrate may be hollow, but rigid, or partially hollow (i.e., porous polymeric solid). In such variations, the polymeric surface is part of the polymeric substrate, particularly the top portion, and the term "polymeric substrate" is used to refer to the entire assembly. Hollow, or partially hollow, polymeric substrates of the invention may be rigid as a result of the polymer and the polymer's characteristics (e.g., cross-linking), or as a result of additional support (e.g., internal or external reinforcement). As with the exemplary reservoir-supported membrane described below, the internal portion of either a hollow or partially hollow polymeric substrate may contain one or more inlets and one or more outlets for the transfer of fresh and spent polishing formulation. In addition, the polymeric substrates may comprise interconnected pores or capillaries. In hollow polymeric substrates, pores and capillaries are typically limited to the polymeric surface; however, in partially hollow polymeric substrates, pores and capillaries are typically spread throughout the body of the polymeric substrate to facilitate fluid flow. As such, pores or capillaries that begin in the internal portion of partially hollow polymeric substrates extend to and terminate at the polymeric surface. Pore and/or capillary dimensions are described in more detail below.

In other variations, the polymeric substrate may not be configured to hold one or more phases of a polishing formulation. In such variations of the invention, the polymeric substrate may be extended, e.g., stretched, across the top of a reservoir-type structure (e.g., like a drum) or placed atop a reservoir-type structure configured to hold one or more phases of a polishing formulation. The reservoir-type structure, also termed a "body," may comprise a polymeric material or a non-reactive material other than a polymeric material. In some embodiments, the body may be selected from a tank, a reservoir, a chamber, a receptacle, and the like. In a non-limiting example, the polymeric substrate comprises a membrane-type structure supported by a polishing formulation-containing reservoir with an inlet and an outlet for the transfer of fresh and spent polishing formulation. Continuing with this non-limiting example, the reservoir may be polymeric; however, the polymeric substrate and polymeric support structure may or may not be of the same polymeric composition.

In some embodiments, the polymeric substrate of the polishing apparatus may be about 0.1 mm to about 25 mm high (or tall or thick).

In some embodiments, the polymeric surface of a hollow polymeric substrate may be about 0.5 mm to about 50 mm thick.

In some embodiments, the polymeric substrate is parallelepiped in shape. As such, the parallelepiped polymeric substrate may be about 200 mm to about 1500 mm long and about 200 mm to about 1500 mm wide.

In some embodiments, the polymeric substrate of the polishing apparatus is circular or elliptical in shape. As such, the circular or elliptical polymeric substrate may have a diameter or major axis between about 200 mm to about 1500 mm depending upon the polish substrate size and the polish platform (tool) configuration.

In addition, the polymeric substrate (or body) may further comprise a volume of polishing or rinse formulation. In some embodiments, the volume capacity of the polymeric substrate is about 50 mL to about 50 L.

The polymeric substrate may be sized relative to the polish substrate. In some embodiments, the polymeric substrate, particularly the portion of the polymeric substrate in contact with the polish substrate (i.e., polymeric surface), is slightly larger (e.g., 10-50% larger, or more) than the polish substrate. For example, the polymeric substrate may be 50% larger than the polish substrate in need of polishing. Generally, a polymeric substrate that is 2× that of the polish substrate is sufficient. The size of a polymeric substrate in relation to a polish substrate may also depend upon the process, that is, whether it is a single-substrate or multi-substrate polishing process. In general, a single polish substrate is polished at a time. Size preference may also depend upon the mode of relative motion (if any), the flow of the polishing formulation, and the tooling and instrumentation requirements of the equipment set up.

The polishing apparatus of the invention may comprise a polymeric substrate (or body) that is divided into two or more different sections or "zones," wherein each zone may be physically different (e.g., roughness, hardness, and the like) than an adjacent zone, and further wherein each zone may be supplied with one or more phases of a polishing formulation through a dedicated inlet/outlet or "channel." Through different chemical and physical arrangements, the polishing characteristics of each zone may be different. Using different channels, one or more phases of a polishing formulation may be routed through the polymeric substrate, and hence, the polymeric surface, in a variety of trajectories and at a variety of different flow rates to effect desired removal rates and uniformity. Different zones also allow for different polishing formulations (or one or more phases of a polishing formulation) to be used simultaneously. In addition, different zones may allow for one or more phases of a polishing formulation to be used in one zone and a rinsing fluid to be used in an adjacent zone. This feature may be useful if metal or metal-containing material is being removed too quickly (as may be indicated from any of various end point methodologies) from a portion of a polish substrate. Using zones, polishing formulation flow rate may be reduced (or stopped) to slow down removal of metal or metal-containing material from the polish substrate. In addition, polishing formulation supplied to a zone may be diluted to slow down or attenuate metal of metal-containing material removal rates. In some embodiments, the polymeric substrate may be divided into two, three, or four zones, wherein the polymeric surface is mapped onto each zone.

Alternatively, or in addition to supplying one or more phases of a polishing formulation to the polymeric surface from the within the polymeric substrate (via inlets/outlets in the side or bottom), a polishing formulation of the invention may be supplied in a rotary, linear, or spiral manner, or in any combination thereof. In addition, one or more phases of the polishing formulation may be transferred through the polymeric substrate perpendicular to the wafer surface. In some embodiments, the polymeric substrate may be very thin, taut, and soaked with one or more phases of the polishing formulation, wherein any polishing formulation phase or combination thereof, is supplied from above (e.g., trickles down), from below (e.g., polymeric substrate is submerged in the polishing formulation), or subject to a process or any combinations of process steps that results in one of the foregoing. In such variations, the polymeric substrate may have a thickness of 0.5 mm or thicker (likely, 2-5 mm or thicker), depending on the polishing formulation and the manner in which it is delivered.

The polishing apparatus of the invention, in alternative variations, may comprise a hollow polymeric substrate or body (e.g., reservoir) with additional internal features. In some embodiments, the polymeric substrate may comprise one or more internal porous polymeric membranes that partition the hollow space into two or more partitions. In a non-limiting example, the polymeric substrate is partitioned into two partitions by one internal porous polymeric membrane. In such a system, the porous polymeric membrane may support an organic liquid membrane in direct contact with both an external aqueous phase and an internal aqueous phase contained within the polymeric substrate. In some embodiments, the polymeric substrate comprises one or more hollow and porous polymeric fibers within its body. In a non-limiting example, the polymeric substrate comprises a single hollow polymeric fiber in a coil or another space-accommodating design. In such a system, the porous polymeric fiber may support an organic liquid membrane. In addition, the porous polymeric fiber may be immersed in a bath of external aqueous phase while the internal aqueous phase is within the porous polymeric fiber.

Referring to FIG. 14A-C, three variations of polishing apparatus comprising zoned polymeric substrates/surfaces are shown. Polishing apparatus (1400A), for instance, comprises a zoned polymeric surface (1403A) in which the outer concentric zone is wetted with polishing formulation (1420A) to form a boundary layer (1404A). The arrows show polishing formulation (1420A) as being delivered to the polymeric surface (1403A) from below. (See FIG. 17 for another representation of FIG. 14A.) Delivery of polishing formulation (1420A) may be accomplished through a shower or sprinkler system. Other delivery methods are also possible, including delivery through a misting system or through a focused jet stream. The inner concentric zones of polymeric surface (1403A) may be wetted with polishing formulation in the same manner; however, for the purpose of clarity, only the outer zone of polymeric surface (1403A) is shown and described. Polishing apparatus (1400B) also comprises a zoned polymeric surface (1403B) in which the outer concentric zone is wetted with polishing formulation (1420B) to form a boundary layer (1404B). In this instance, the polishing formulation (1420B) is shown as being delivered into the polymeric substrate through and inlet and exiting the polymeric substrate through an outlet. The curved arrows in FIG. 14B indicate the flow of the polishing formulation (1420B) beneath the polymeric surface (1403B). In an alternative embodiment, the flow of polishing formulation follows the arrows of FIG. 14C, wherein the components are similar to those described in FIG. 14 A and FIG. 14. B. As in other embodiments of the invention, the polishing formulation (1420B/C) permeates through the polymeric substrate and, ultimately, forms a boundary layer (1204B/C) on the polymeric surface (1403B/C). Again, for the purpose of clarity, only the outer zone of polymeric surface (1404B/C) is shown and described. It is to be understood that inner concentric zones may be supplied and wetted with polishing formulation in the same manner.

Polymeric Surface

The polymeric surface is configured to interface with a metallized surface to be polished, and thus provides the location at which one or more phases of polishing formulation and the metallized surface can interface. The polymeric surface may be porous and in fluid communication with the internal portion of the polymeric substrate (whether it is hollow or partially hollow), which contains one or more phases of a polishing formulation. In variations wherein the polymeric substrate is disposed atop a reservoir, the polymeric surface may be in fluid communication with the internal portion of the reservoir, which contains one or more phases of a polishing formulation.

As described above, in certain variations, the polymeric substrate may not be configured to support one or more phases of a polishing formulation. In such variations of the invention, the polymeric substrate, conceptually approximating a polymeric surface, may be supported mechanically and may comprise a permeable membrane (e.g., semi-permeable, selectively-permeable, partially-permeable, or differentially-permeable membranes). In certain embodiments, the polymeric substrate/surface may comprise a semi-permeable membrane replenished with a reservoir. In a non-limiting example, the polymeric substrate/surface is a selectively-permeable membrane replenished with a polishing formulation-containing tank with an inlet and an outlet for the transfer of fresh and spent polishing formulation. Polymeric substrates/surfaces may have interconnected pores or capillaries. Pore and/or capillary dimensions are described in more detail below.

The polymeric surface of the polishing apparatus may further comprise a window, "local area transparency," or hole for use with an optical laser, eddy current, motor current, friction, and/or electrochemical endpoint detection method. In some embodiments, the polymeric surface comprises a window, local area transparency, or hole that is about 0.2 mm to 5 mm in diameter, such as 2 mm to 3 mm in diameter. As used herein, by "local area transparency" is meant a localized area of a polymeric surface that is transparent to specific frequencies and intensities of laser light, and that may be used in optical endpoint detection systems such as those used in conventional CMP processes. As used herein, by "window" is meant a discrete polymer material plugged into a polymeric surface, wherein that plug is used to transfer laser light for optical endpointing in CMP processes with the Applied Materials, Inc. polishing tools.

Polymeric Surface/Substrate Properties

The polymeric surface may contain additional features (e.g., grooves common to CMP pads); however, the polymeric surface is generally without additional features, and generally without grooves. For instance, the polymeric surface may be flat at micro- and/or nano-scale. In some embodiments, the polymeric surface may have a roughness of about 0.0001 μm (0.1 nm) to about 1000 μm. For example, the polymeric surface may have an Ra value ranging from about 5 nm to about 100 nm based on small dimensional (3 μm×3 μm) surface roughness measurement methodology using atomic force microscopy ("AFM"). For larger dimensional scale surface roughness measurement the values may range from about 10 nm to about 1000 nm with AFM.

Surface roughness may provide the mechanical contact between the polymeric surface and the polish substrate. In conventional CMP, the asperities are important as they press the abrasives of the slurry into the surface of the substrate being polished. In the present invention, the asperities help transfer the polishing formulation through good wetting of the surface asperities. Each asperity may be viewed as a wetted wick contacting the polish substrate, and thus, a means of transferring the polishing formulation. Longer or taller asperities may increase removal rates locally; however, if there is a large variation in asperity size across different pad regions, there may be non-uniformity across the substrate. As such, control of surface roughness will be important. The engineering and science around asperity size, distribution, and combination contribute to the mechanical aspects associated with the CMP process. In contrast to conventional CMP processes that uses abrasives, the mechanical action of the present invention arises from the interaction of the asperities with the surface of the polish substrate. As such, this is a "soft" mechanical process unlike conventional CMP, which is driven by downforces and mechanical abrasion of the surface of the polish substrate.

The effect of grooving can be achieved through prescribed flow patterns of the formulary liquid membrane solution to the polish substrate in a way that eliminates the need for surface grooving. In fact, the flow patterns may be changed in real time through flow rates and flow paths. Further variations are possible through real-time change of formulation chemistries. Different chemistries in addition to the above changes can introduce the customization to the material removal rates especially in combination with endpoint detection. Such customization is important as it is useful to control film thicknesses after polish to match or offset pre-polish film thicknesses and to create desirable uniformity or variation from center to edge of a polish substrate. Such can be perceived as a concept for grading for variation of material removal rates across a polish substrate.

The pores or capillaries of the polymeric substrate may be microscale or nanoscale pores or capillaries (e.g., micropores, nanopores, microcapillaries, or nanocapillaries), or in any combination thereof. Generally, the pores or capillaries may randomly interconnect with each other forming a network of pores or capillaries that facilitate polishing formulation distribution. A pore that interconnects one or more pores or capillaries is generally on the same scale as the surrounding pores or capillaries. That being said, an interconnecting pore or capillary may be larger than the surrounding pores or capillaries, smaller than the surrounding pores or capillaries, or the same dimensions as the surrounding pores or capillaries, or in any combination thereof. In some embodiments, the pores or capillaries and/or interconnecting pores or capillaries are roughly uniform in size and uniform in distribution. In some embodiments, the pores or capillaries and/or the interconnecting pores or capillaries are roughly uniform in size and variable in distribution (e.g., more dense toward center of polishing apparatus and less dense toward the edges). In some embodiments, the pores or capillaries and/or the interconnecting pores or capillaries are variable in size and uniform in distribution. In some embodiments, the pores or capillaries and/or the interconnecting pores or capillaries are variable in size and variable in distribution.

In some embodiments, the pores or capillaries and/or the interconnecting pores or capillaries are 1 nm to 1000 μm in diameter. In a particular embodiment, the pores or capillaries and/or the interconnecting pores or capillaries are 200 μm in diameter. In some embodiments, the pores or capillaries and/or the interconnecting pores or capillaries are an average of 0.02 to 0.2 μm in diameter. In a particular embodiment, the pores or capillaries and/or the interconnecting pores or capillaries are an average of 100 μm in diameter. In some embodiments, the pores or capillaries and/or the interconnecting pores or capillaries are 0.1 nm to 500 mm in length. In a particular embodiment, the pores or capillaries and/or the interconnecting pores or capillaries are 100 μm in length.

The percent porosity is the fraction of the pore volume to the bulk polymer material volume, exclusive of the hollow core space. In some embodiments, the percent porosity is in the range of about 20 to about 90%, such as about 60 to about 80%. The pore density along with pore size and distribution may be adjusted to provide selectivity and desired removal rates to the polishing process as the pores directly control the amount of polishing formulation that is delivered to and removed from the surface of the polish substrate.

The polymeric substrate of the polishing apparatus comprises one or more of, in any combination, polypropylene (e.g., CelGard® 3401 or Celgard® 2500 polypropylene), polycarbonate (e.g., Nuclepore® polycarbonate), polybenzimidazole, high-density polyethylene (HDPE), polyolefins, polysulfones, polytetrafluoroethylenes, polystyrenes, hydrophobic polypropylene glycol, hydrophobic polybutylene glycol. In certain embodiments, the polymeric substrate of the polishing apparatus comprises polypropylene (e.g., CelGard® 3401 or CelGard® 2500). In certain embodiments, the polymeric substrate of the polishing apparatus comprises polycarbonate (e.g., Nuclepore®). In a non-limiting example, the polymeric substrate of the polishing apparatus comprises microporous polybenzimidazole ("PBI," a class of linear polymers whose repeat unit contains a benzimidazole moiety) as PBI may be advantageous over other polymeric supports such as polypropylene and polycarbonate in the separation of chemical species such as copper, neodymium, and the like. The polybenzimidazoles useful in the invention may comprise any polybenzimidazole resin known to those skilled in the art. Non-limiting examples of PBI's include poly-2,5(6)-benzimidazole; poly-2,2'-(meta-phenylene)-5,5'-bibenzimidazole; poly-2,2'-(pyridylene-3",5")-5,5'-bibenzimidazole; poly-2,2'-(furylene-2",5")-5,5'-bibenzimidazole; poly-2,2'-(naphthalene-1",6")-5,5'-bibenzimidazole; poly-2,2'-(biphenylene-4",4")-5,5'-bibenzimidazole; poly-2,2'-amylene-5,5'-bibenzimidazole; poly-2,2'-octamethylene-5,5'-bibenzimidazole; poly-2,6-(meta-phenylene)-5,5'-diimidazobenzene; poly-2,2'-cyclohexeneyl-5,5'-bibenzimidazole; poly-2,2'-(meta-phenylene)-5,5'-di(benzimidazole) ether; poly-2,2'-(meta-phenylene)-5,5'-di(benzimidazole) sulfide; poly-2,2'-(meta-phenylene)-5,5'-di(benzimidazole) sulfone; poly-2,2'-(meta-phenylene)-5,5'-di(benzimidazole) methane; poly-2,2'-(meta-phenylene)-5,5'-di(benzimidazole) propane-2,2; and poly-2',2"-(meta-phenylene)-5',5"-di(benzimidazole) ethylene-1,2. Any polymerization process known to those skilled in the art may be used to prepare PBI, which, in turn, may be formed into a microporous polymeric substrate for use in the invention. In some embodiments, aromatic polybenzimidazoles may be prepared by self-condensing aromatic or heteroaromatic compounds comprising a pair of ortho amino substituents and, for example, an ester substituent. In a non-limiting example, poly-2,5(6)-benzimidazole may be prepared by the autocondensation of phenyl-3,4-diaminobenzoate. In some embodiments, aromatic polybenzimidazoles may be prepared by condensing aromatic or heteroaromatic compounds comprising two pairs of ortho amino substituents (e.g., benzene-1,2,4,5-tetraamine) with a dicarboxylic acid or dicarboxylic acid derivative (e.g., esters, including anhydrides) selected from, for example, aromatic or heteroaromatic dicarboxylic acids or dicarboxylic acid derivatives (e.g., dicarboxylic acids or dicarboxylic acid derivatives of various pyridines, pyrazines, furans, quinolines, thiophenes, and the like), aliphatic or heteroaliphatic dicarboxylic acids or dicarboxylic acid derivatives (e.g., dicarboxylic acids or dicarboxylic acid derivatives of various malonic acids, succinic acids), esters of cyclic or heterocyclic dicarboxylic acids or dicarboxylic acid derivatives (e.g., dicarboxylic acids or dicarboxylic acid derivatives of various cyclohexanes, pyrans, and the like). In a non-limiting example of reaction conditions, equimolar quantities of an aromatic tetraamine and a dicarboxylic acid or dicarboxylic acid derivative compound may be introduced into a first stage melt polymerization reaction zone and heated therein at a temperature above about 200° C.

Numerous other polymers may be used for the polymeric substrate of the polishing apparatus, including thermoplastics, thermosets, elastomers (rubbers), and the like. Examples of thermoplastic classes include, but are not limited to, olefinics, vinylics, styrenics, acrylonitrilics, acrylics, cellulosics, polyamides, polyesters, polycarbonates, sulfone polymers, ether-oxide polymers, and related copolymers and polyalloys. Among the class of thermosets, examples include, but are not limited to, polymers of formaldehyde systems, furane systems, allyl systems, alkyl systems, unsaturated polyester systems, vinylester systems, urethane/urea systems. Among the class of elastomers (rubbers), examples include, but are not limited to, diene and related elastomers, elastomeric co-polymers, ethylene related elastomers, fluoro and silicone polymers.

In some embodiments, the polishing apparatus comprises a polymeric substrate comprising a polymer having a density of about 0.3 g/cc to about 2.00 g/cc.

In some embodiments, the polishing apparatus comprises a polymeric substrate comprising a polymer having a compressibility of about 0.5 to about 0.6 or bulk modulus of $5\times10^7$ to $30\times10^7$ N/m$^2$.

In some embodiments, the polishing apparatus comprises a polymeric substrate comprising a polymer having a hardness of about 70 shore A to about 75 shore D.

Other important polymer properties may include chemical stability to the polishing formulation and any rinses that are used in the polishing process; wettability (hydrophilicity), particularly wettability of the polymeric surface; resistance to mold formation, algae development, and bio-degradation; and controllable swelling (limited to be from about 10% to about 100%).

In general, a membrane-like (or thin-bodied) polymeric substrate, whether rectangular, circular, or elliptical in shape, is of sufficient length and width to cover its respective body (e.g., reservoir); however, a membrane-like (or thin-bodied) polymeric substrate may have greater or lesser dimensions than its body depending upon polishing needs.

Polishing Formulations

As described above, the polishing formulation used in the polishing apparatus and methods described herein may generally comprise a mono-, bi-, tri-, or multi-phasic liquid. In some variations, a polishing formulation may be substantially, essentially, or entirely free of abrasives. In general, the polishing mechanism utilized herein comprises two steps: the formation and dissolution of metal cations in an aqueous phase in contact with the surface being polished from solid metal or solid metal-containing surface species, and the removal of the metal cations from that aqueous phase, and therefore away from the polished surface. As such, a polishing formulation may comprise an aqueous phase for the formation and dissolution of metal cations, and/or one or more complexing agents. The complexing agent may be typically contained within an organic phase that is substantially immiscible with water so as to extract and remove metal cations from aqueous solution.

In some variations, a single polishing formulation may comprise both an aqueous phase and an organic phase to complex metal cations, e.g., bi- or tri-phasic polishing formulations may be used. It should be noted that different phases may be applied separately, e.g., one phase of a polishing formulation may be applied to a surface to form and solvate metal cations, whereas another phase may be used to complex metal cations, e.g., within a polymeric substrate. When more than one separate phase is used, the phases may be used sequentially or in parallel.

As described above, one or more components of a polishing formulation may in some instances be delivered to a polish substrate by permeating through a polymeric substrate, and in some cases, one or more components of a polishing formulation may be supported by or contained within a porous polymeric substrate, e.g., as a SLM. Thus, a polishing formulation may be designed to have any suitable physical properties corresponding to a method used to deliver that formulation to the surface to be polished. For example, in some variations, a polishing formulation may have a viscosity similar to that of water (e.g., about $8.90\times10^{-4}$ Pa·s; 8.90×10-3 dyne·s/cm$^2$; or 0.890 cP at about 25° C.). However, in some embodiments, the polishing formulation may have a viscosity greater than or less than that of water, e.g., a viscosity may be selected to have particular flow properties through a polymeric substrate and/or the number, type, and amount of oxidants, acids, bases, surfactants, complexing agents and/or additives used.

A mono-phasic polishing formulation may contain a single liquid, two or three liquids, or more than three liquids, provided that each liquid in combination is miscible. Likewise, a bi-phasic polishing formulation may contain two, three, four or more liquids, provided that the liquids, in combination, provide two substantially immiscible phases. In bi-phasic formulations, one phase may be dispersed in the other, e.g., to form an emulsion. For example, a non-limiting example of a bi-phasic polishing formulation may comprise an organic solvent (or organic solution) dispersed in water (or an aqueous solution) to from an emulsion. A tri-phasic polishing formulation, like a bi-phasic formulation, may contain two, three, or four or more liquids, provided that the liquids, in combination, provide three substantially separate phases. In a non-limiting example of a tri-phasic polishing formulation, water (or an aqueous solution) may be dispersed in an organic solvent (or organic solution) to form a primary emulsion, which, in turn, is dispersed in water (or an aqueous solution) to from a secondary emulsion. Multi-phasic polishing formulations in the spirit of bi-phasic and tri-phasic polishing formulations are also possible.

Depending upon the function of a phase in a polishing formulation, a mono-, bi-, tri-, or multi-phasic polishing formulation may further comprise one or more components selected from the group consisting of oxidants, acids, bases, surfactants, complexing agents, accelerators, corrosion inhibitors (including passivating agents), stabilizers, end-point detectors, and combinations thereof.

In general, metal may be removed from a polish substrate using an aqueous phase comprising one or more oxidizing agents. In a non-limiting example, copper may be removed from a semiconductor wafer using an aqueous phase comprising an oxidizing agent. In some embodiments, an oxide-removing agent may optionally be added to an aqueous phase to dissolve oxidized material. For removal of a metal, e.g., copper, from a polish substrate, any oxidizing agent having an oxidation-reduction potential suitable for the oxidation of the metal, or an oxide of the metal, may be used.

Any oxidizing agent now known or later developed may be used in combination with the polishing apparatus and methods described herein to form metal ions in aqueous solution. The strength of the oxidizing agent may be selected to tune the extent and kinetics of the oxidation process, e.g., a strong oxidizing agent may be used for relatively rapid removal of large amounts of metal, whereas a weaker oxidizing agent may be used for slower more gradual removal of metal. That is, in some variations, an aqueous solution may be applied as a thin boundary layer or otherwise to a surface to be polished separately from a phase comprising a complexing agent, e.g., by a jet or by dipping a surface in a solution.

In some variations, oxoacids of halogens and their salts (e.g., alkali metal salts) may be suitable oxidants for an aqueous phase used to dissolve metal ions from a polish substrate, for example oxoacids containing halide atoms such as chlorine, bromine, or iodine bonded to one, two, three, or four oxygen atoms. Non-limiting examples of oxoacids that may be used as aqueous oxidizing agents include perchloric acid ($HOClO_3$); chloric acid ($HOClO_2$); chlorous acid ($HOClO$); hypochlorous acid ($HOCl$); and the respective salts thereof (e.g., sodium perchlorate ($NaClO_4$); ammonium perchlorate ($NH_4ClO_4$); tetramethylammonium perchlorate ($Me_4NClO_4$); sodium chlorate ($NaClO_3$); ammonium chlorate ($NH_4ClO_3$); tetramethylammonium chlorate ($Me_4NClO_3$); sodium chlorite ($NaClO_2$); ammonium chlorite ($NH_4ClO_2$); tetramethylammonium chlorite ($Me_4NClO_2$); and sodium hypochlorite ($NaOCl$)). Bromine and iodine analogs (e.g., ammonium periodate ($NH_4IO_4$); tetramethylammonium periodate ($Me_4NIO_4$); potassium iodate ($KIO_3$); ammonium iodate ($NH_4IO_3$); tetramethylammonium iodate ($Me_4NIO_3$)) are also known and may be useful as oxidants in the external phase. Additional non-limiting examples of oxidizing agents suitable for use in an aqueous phase include nitric acid ($HNO_3$); sulfuric acid ($H_2SO_4$); hydrogen peroxide ($H_2O_2$); urea hydrogen peroxide ($CO(NH_2)_2.H_2O_2$); ferric chloride ($FeCl_3$); ferric nitrate ($Fe(NO_3)_3$); potassium ferricyanide ($K_3[Fe(CN)_6]$); cupric chloride ($CuCl_2$); persulfates (e.g., ammonium persulfate ($(NH_4)_2S_2O_8$) and tetramethylammonium persulfate ($(Me_4N)_2S_2O_8$)); perborates (e.g., ammonium perborate ($NH_4BO_3$) and tetramethylammonium perborate ($Me_4NBO_3$)); chromic acids; and any combinations of these or any other oxidizing agents disclosed herein. N-oxides having the formula ($R_1R_2R_3N\rightarrow O$), wherein $R_1$, $R_2$, and $R_3$ are independently selected from the group consisting of hydrogen and $C_1$-$C_8$ alkyl, are also suitable oxidants for the external aqueous phase. Specific examples of amine N-oxides include but are not limited to 4-methylmorpholine N-oxide and pyridine N-oxide.

Along with the type and strength of an aqueous oxidizing agent, the concentration of the oxidizing agent may be tuned according to the substrate being polished, e.g., the type of metal, the degree of surface oxidation present, the flatness desired, and the kinetics desired. For example, aqueous solutions have a concentration in a range from about 0.01% to about 50% (w/v) may be used in some embodiments. In other embodiments, the concentration of the oxidizing agent may be in a range from about 0.02% to about 40% (w/v). In certain embodiments, the aqueous concentration of the oxidizing agent may be in a range from about 0.03% to about 30% (w/v).

Further, as described above and used herein, the term "oxide-removing agent" is defined as any substance that in the presence of a water-containing solution dissolves basic metal oxides. For example, it may be advantageous in some circumstances to add an oxide-removing agent to dissolve copper oxides. Oxide-removing agents useful in the present invention include but are not limited to mineral acids (i.e., hydrochloric acid, nitric acid, and sulfuric acid), inorganic acids (i.e., phosphoric acid and fluoroboric acid), and organic acids (i.e., oxalic acid; malonic acid; malic acid; citric acid; acetic acid; and pivalic acid).

In some variations, an aqueous solution in contact with a surface to be polished may comprise one or more reducing agents to reduce a metal-containing species. For example, a reducing agent may be used to reduce a valence state of a metal cation to tune the solubility of that cation, e.g., ascorbic acid may be used to reduce $Cu^{2+}$ to $Cu^{1+}$ in certain circumstances. Reducing agents may be used to control the removal rate and/or selectivity of one or more exposed metal species, a typical scenario in current CMP processes (e.g., damascene process for copper interconnects with Ta/TaN as underlying metal barrier films). For example, it may be desirable to control selectivity for copper and slow down copper removal with respect to Ta/TaN. Such control may be done in conjunction with endpoint detection. When a particular endpoint is reached, the chemical composition of the polishing formulation may be changed as well as flow rates and droplet size and concentration (if an emulsion-based polishing formulation).

As described herein, certain polishing formulations may comprise one or more complexing agents to extract metal cations from an aqueous solution in contact with a polish substrate. Non-limiting examples of complexing agents that may be used in polishing formulations described herein include ethylenediaminetetraacetic acid ("EDTA"), sulfosalicylic acid, acidic organophosphorus compounds such as octyl(phenyl)-N,N-diisobutylcarbamoylmethyl phosphine oxide (CMPO); macrocyclic polyethers, such as crown ethers, aza crown ethers; calixarenes; 1-(2-pyridylazo)-2-naphthol (PAN); neocuproine (2,9-dimethyl-1,10-phenanthroline); polyethylene glycol; organophosphoric acids, such as diethylhexylphosphoric acid, di-(2-ethylhexyl) phosphoric acid (D2EHPA), monododecylphosphoric acid, and octaphenylphosphoric acid; organophosphinic acids, such as bis(trimethylpentyl)phosphinic acid; organophosphorus acid esters, such as trioctylphosphine oxide and tributyl phosphate; beta-diketones; beta-hydroxyoximes, such as 2-hydroxy-5-nonylacetophenone oxime; secondary amines, such as dodecylamine; tertiary amines, such as tridecylamine, tri-n-octylamine, and triphenylamine; alkylated ammonium salts, such as tridodecylammonium chloride; ammonium hydroxide (as ammonia); carboxylic acids, such as naphthenic acids; and alkylated cupferrons, such as the ammonium salt of N-(alkylphenyl)-N-nitrosohydroxylamine. A complexing agent such as dithizone may be used in separating metal ions such as cadmium, copper, lead, mercury, or zinc, while a complexing agent such as thioxine may be used in separating metal ions such as antimony, arsenic, bismuth, cadmium, copper, cobalt, gallium, gold, indium, iridium, iron, lead, manganese, mercury, molybdenum, nickel, osmium, palladium, platinum, rhenium, rhodium, ruthenium, selenium, silver, tantalum, tellurium, thallium, tin, tungsten, vanadium, or zinc.

Metals, e.g., copper, may be removed from a polish substrate over a wide pH range (e.g., pH 1-14). However, at low pH and at high pH, a metal such as copper may corrode. At near neutral pH, and at slightly basic pH, metals, e.g., copper, may be passivated by one or more oxide coatings (e.g., copper may be passivated by cuprous oxide and cupric oxide coatings). As such, the pH of the aqueous solution can have a significant effect on the metal-containing species present on a surface, and on the metal removal rate. Conditions may be chosen (e.g., based on pH and oxidation-reduction potential) to selectively remove one metal at a greater rate than another metal or metal-containing species (e.g., oxide, nitride, and the like) on the same polish substrate. In some embodiments, the optimum pH range is about 7 to about 13 and the optimum standard reduction potential (vs SHE) is about −2V to 0.2V for copper. At potential above −0.4V, copper needs passivation. Regarding Ta, the corresponding optimum pH range is about 1 to about 14 and the optimum standard reduction potential (vs SHE) is about −1.8V to −0.6V. Such information regarding pH and oxidation-reduction potential for copper, tantalum, and other materials is readily available through Pourbaix diagrams from a variety of sources. Acids and bases may be added to the polishing formulation to buffer and control the pH of an aqueous solution. Acids suitable for use in the polishing formulation of the invention include nitric acid; hydrochloric acid; and polyprotic acids, such as sulfuric acid, phosphoric acid. Bases suitable for use in the polishing formulation of the invention include potassium hydroxide and ammonium hydroxide. Buffered polishing formulations of the invention may include polyprotic acids fully or partially neutralized with, for example, ammonium hydroxide to make ammonium salts such as, phosphoric acid-ammonium phosphate, polyphosphoric acid-ammonium polyphosphate, boric acid-ammonium tetraborate, boric acid-ammonium pentaborate.

Corrosion inhibitors, which slow down or stop corrosion of metal and metal-containing materials, may be used in polishing formulations. Passivating agents are corrosion inhibitors that react with a metal surface to form a thin film that passivates, or protects, the metal surface. Passivating agents may be used in the polishing formulation of the invention to passivate the metal (e.g., copper, tantalum, and the like) surface, thereby reducing corrosion and roughening, especially when a polishing formulation is outside a metal's domain of passivation (i.e., outside the oxidation-reduction potential vs. pH range wherein the metal is passive). Non-limiting examples of passivating agents include triazoles, such as 1,2,4-triazole ("TAZ"), or triazoles substituted with groups such as $C_1$-$C_8$ alkyl (e.g., methyl, ethyl, isopropyl, sec-butyl, neopentyl, and this like), amino, hydroxy, mercapto, imino, carboxy, and nitro; benzotriazole (BTA); tolyltriazole (TTA); 5-phenylbenzotriazole; 5-phenyl-4H-1,2,4-triazole-3-thiol (PTAT); 5-nitro-benzotriazole; 3-amino-5-mercapto-1,2,4-triazole; 1-amino-1,2,4-triazole; hydroxybenzotriazole; 2-(5-aminopentyl)-benzotriazole; 1-amino-1,2,3-triazole; 1-amino-5-methyl-1,2,3-triazole; 3-amino-1,2,4-triazole; 3-mercapto-1,2,4-triazole; 3-isopropyl-1,2,4-triazole; 5-phenylthiolbenzotriazole; 4-methyl-4H-1,2,4-triazole-3-thiol; halobenzotriazoles, wherein halo is selected from the group consisting of fluoro, chloro, bromo, and iodo; naphthotriazole; and the like. Non-limiting examples of passivating agents also include thiadiazoles, such as 2-amino-5-ethyl thiadiazole (AETD or AETDA); thiazoles, such as thiazole, benzothiazole, 2-mercaptobenzothiazole, 5-benzylidene-2,4-dioxotetrahydro-1,3-thiazole (BDT), 5-(3'-thenylidene)-2,4-dioxotetrahydro-1,3-thiazole (TDT), 5-(4'-isopropylbenzylidene)-2,4-dioxotetrahydro-1,3-thiazole (IPBDT), and 5-(3',4'-dimethoxybenzylidene)-2,4-dioxotetrahydro-1,3-thiazole (MBDT); tetrazoles, such as 5-aminotetrazole, methyltetrazole, 1,5-pentamethylenetetrazole, 1-phenyl-5-mercaptotetrazole, 5-mercapto-1-methyl tetrazole, and 5-mercapto-1-phenyl tetrazole; imidazoles, such as imidazole, benzimidazole, 2-mercaptobenzimidazole (MBI), and 4-methyl-2-phenylimidazole; phosphates, such as tritolyl phosphate; thiols, such as 2-mercaptothiazoline, 1H-imidazole-4-thiol, 5-amino-1,3,4-thiadiazole-2-thiol, and 5-amino-1,3,4-thiadiazole-2-thiol; triazines, such as triazine, 2,4-diamino-6-methyl-1,3,5-triazine, and diaminomethyltriazine; and the like. Additional non-limiting example of passivating agents include 1,3-dimethyl-2-imidazolidinone and indazole. Carboxylic acids such as benzoic acid and ammonium benzoate may also be used as passivating agents for the polishing formulation of the invention. One, two, three, or more of the above passivating agents, in any combination, may be used in the polishing formulation of the invention.

One, two, three, or more surfactants may be used to lower the interfacial tension between phases, increase the kinetic stability of each phase, and tune droplet sizes in an emulsion. In the context of the invention, surfactants may assist in stabilizing emulsions, thereby reducing the tendency for the emulsions to separate into their respective bulk phases. Aggregates may be formed from surfactants, non-limiting examples of which include micelles and inverse micelles. In general, when aggregates are desired, surfactants are used in a concentration sufficient to produce micelles. In other words, the surfactant concentration is generally equal to or greater than the "critical micelle concentration" ("CMC"), the concentration above which micelles spontaneously form. In some embodiments, the total surfactant concentration in the polishing formulation is about 1% to about 40% by weight. In addition, surfactants of the invention generally have a hydrophile-lipophile balance ("HLB") number from about 8 to about 15. In some embodiments, the HLB number is from about 9 to about 10. Non-limiting examples of surfactants that may be used in or with the invention include ionic surfactant and non-ionic surfactants including polyoxyalkylene alkyl ethers (e.g., polyoxyethylene lauryl ether), polyoxyalkylene alkyl phenols, polyoxyalkylene esters, polyoxyalkylene sorbitan esters, polyoxyalkylene sorbitol esters, sorbitan esters (e.g., sorbitan monooleate (Span-80)), polyols (e.g., polyethylene glycol). Based on the emulsion type (e.g., oil-in-water or water-in-oil), many possibilities exist for the choice of surfactant exist. Generally, for oil-in-water emulsions, HLB values are respectively high (12-16); for water-in-oil emulsion, HLB values are lower (7-11). Surfactants may be water or oil soluble, or dispersible. A non-limiting example of water-in-oil surfactant is Triton X-35 (HLB is about 7.8). A non-limiting example of oil-in-water surfactant is Triton X-100 (HLB is about 13.4). In some embodiments, combinations of different surfactants are used to generate the appropriate HLB value. Other surfactants that are applicable are TERGITOLS or nonylphenol ethoxylates ("NPE") with ethylene oxide/propylene oxide co-polymers.

In certain variations, accelerators, stabilizers, and/or endpoint detectors may be used. The chemical endpointing could use 1-(2-Pyridylazo)-2-Naphthol ("PAN"), a dye typically used as a metal complexing agent that is a metal detector, in a detection methodology such as chelatometric titration or other colorimetric titration-based endpointing system.

The oxidants, acids, bases, surfactants, complexing agents and/or additives (e.g., accelerators, corrosion inhibitors (including passivating agents), stabilizers, and endpoint detectors) as discussed above may have more than one role in the polishing formulation. As such, a species described for use as, for example, an acid in the polishing formulation may also find use as an oxidant, even though that particular use may not have been described. In some embodiments, the oxidant and the acid are the same species. In a non-limiting example, nitric acid or sulfuric acid may act as both an acid and as an oxidizing agent in the polishing formulation of the invention. In some embodiments, the complexing agent and the surfactant are the same species. In a non-limiting example, polyethylene glycol may act as both a complexing agent and as a surfactant.

As described above, a bi-phasic polishing formulation may comprise a dispersion of one liquid within another liquid, wherein each is immiscible with the other. The two immiscible liquids may be free of solutes, or contain oxidants, acids, bases, surfactants, complexing agents and/or additives such as accelerators, corrosion inhibitors (including passivating agents), stabilizers, and endpoint detectors. Generally, an organic solution is dispersed in an aqueous solution to form an emulsion, termed an "oil-in-water" or an "organic-in-water" ("O/W") emulsion. In some embodiments, an organic solution comprising a surfactant and a complexing agent is dispersed in an aqueous solution comprising an oxidizing species. In these variations, the aqueous phase comprises an oxidizing species that oxidizes metal at the surface of the polish substrate and dissolves the oxidized metal. Optionally, an oxide-removing agent is present to aid in dissolving oxidized metal species. The dispersed organic phase, which comprises a surfactant (to minimize interfacial tension) and a complexing agent (or extractant or carrier), removes metal cations from the aqueous phase by complexation.

In some embodiments, the drop size of the organic phase in a bi-phasic polishing formulation is about 5 nm to about 10,000 μm.

In some bi-phasic polishing formulations, the volume percent of the organic phase in the aqueous phase is about 5% to about 85%.

As described above, a tri-phasic polishing formulation may comprise a dispersion of one liquid within another liquid, which, in turn, is a dispersion within yet another liquid, wherein each phase is immiscible with the next. The liquids used to form tri-phasic polishing formulation may be free of solutes, and/or contain oxidants, acids, bases, surfactants, complexing agents and/or additives such as accelerators, corrosion inhibitors (including passivating agents), stabilizers, and endpoint detectors. Generally, an aqueous solution is dispersed in an organic solution to form a primary emulsion, termed a "water-in-oil" or "water-in-organic" ("W/O") emulsion, and the primary emulsion, in turn, is dispersed in an aqueous solution to form a secondary emulsion, termed a "water-in-oil-in-water" or "water-in-organic-in-water" ("W/O/W") emulsion. In some embodiments, an acidic aqueous solution is dispersed in an organic solution comprising a surfactant and a complexing agent to form a W/O emulsion, which, in turn, is dispersed in an aqueous solution comprising an oxidizing species to form a W/O/W emulsion. In these variations, the external aqueous phase (i.e., source phase) comprises an oxidizing species that oxidizes metal at the surface of the polish substrate and dissolves the oxidized metal. Optionally, a oxide-removing agent is present to aid in dissolving oxidized metal species. The dispersed organic phase (i.e., liquid membrane), which comprises a surfactant (to minimize interfacial tension) and a complexing agent (or extractant or carrier), removes metal cations from the external aqueous phase by complexation and carries them to the internal aqueous phase. The internal aqueous phase (i.e., receiving phase), in turn, ultimately sequesters the oxidized metal species.

In some embodiments of a tri-phasic polishing formulation, the drop size of the internal aqueous phase in the organic phase is about 1 nm to about 100 μm. In a particular embodiment, the drop size of the internal aqueous phase in the organic phase is about 100 nm.

In some embodiments, the volume percent of the internal aqueous phase in the organic phase is about 5% to about 85%.

Likewise, in some embodiments of a tri-phasic polishing formulation, the drop size of the primary emulsion in the external aqueous phase is about 5 nm to about 10,000 μm. In a particular embodiment, the drop size of the primary emulsion in the external aqueous phase is about 10 μm.

In some embodiments, the volume percent of the primary emulsion in the external aqueous phase is about 5% to about 85%, such as about 20 to about 60%.

FIG. 9 provides, in a non-limiting example not bound by theory, a mechanistic scheme for a polishing formulation comprising a W/O/W emulsion. As shown, the polishing formulation of FIG. 9 comprises source phase (901), receiving phase (903), and liquid membrane (902) intermediate between source phase (901) and (903). In further detail, source phase (901) comprises solvated metal cation (907) (e.g., $Cu^{2+}$) and hydrogen ion (e.g., $H^+$); liquid membrane comprises carrier/complexing agent (904) (e.g., 5-dodecyl-2-hydroxybenzaldehyde oxime) and surfactant (905) (e.g., Span-80), which is present at both interface of (902); and receiving phase (903) comprises stripping agent (906) (e.g., sulfuric acid). Again, without being bound by theory, as a solvated metal cation such as $Cu^{2+}$ reaches the source phase/liquid membrane interface (908), it may be complexed by complexing agent (904) and made soluble in organic phase (902). In this particular example, $Cu^{2+}$ is chelated by two 5-dodecyl-2-hydroxybenzaldehyde oxime molecules and two hydrogen ions are released and deposited in the external aqueous phase. By diffusion or another transport mechanism, the metal complex may reach the liquid membrane/receiving phase interface (910) where it encounters an acidic receiving phase comprising stripping agent (906) (e.g., sulfuric acid). In this example, complexed $Cu^{2+}$ may be exchanged by both 5-dodecyl-2-hydroxybenzaldehyde oxime molecules for two hydrogen ions in a process that mirrors, in reverse, the transfer of $Cu^{2+}$ from the source phase to the liquid membrane. In this way, the carrier/complexing agent (904) may transport metal cations from the source phase (901), across the liquid membrane (902), and into the receiving phase (910).

With reference to the schematic in FIG. 10, an example of a preparation scheme for a W/O/W is shown. In this particular variation, the preparation of a W/O/W emulsion commences by dispersing an aqueous phase (1001) in an organic phase (1002) comprising, for example, a surfactant and a complexing agent. A primary emulsion (1003) having a sufficiently small drop size may be accomplished by vigorous mechanical agitation using, for example, a high-sheer agitator at high speeds. The W/O/W emulsion (1005) is subsequently prepared by dispersing primary emulsion (1003) in an external aqueous phase (1004) comprising an oxidant using a conventional type stirrer. In polishing formulations comprising W/O/W emulsions, the primary role of the external aqueous phase is to remove material (e.g., metals and metal oxides, such as Cu, $Cu_2O$, CuO) from the polish substrate at a sufficient and controllable rate. As such, the external aqueous phase typically comprises one or more oxidants and/or one or more acids. Oxide-removing agents may also be added to aid in basic metal oxide removal In polishing formulations comprising W/O/W emulsions, the primary role of the organic phase is to provide a suitable liquid membrane separating the external and internal aqueous phases. Generally, any organic solvent is suitable for use with the polishing formulation of the invention so long as it is not miscible with the aqueous phases. Such organic solvents may include hydrocarbons, such as n-heptane and dodecane; aromatic hydrocarbons, such as toluene; and halogenated hydrocarbons, such as chloroform and dichloroethane. The organic phase typically comprises one or more surfactants and one or more carriers (e.g., complexing agents), wherein the role of the carrier is to transport metal cations from the external aqueous phase to the internal aqueous phase.

In polishing formulations comprising W/O/W emulsions, the primary role of the internal aqueous phase is to sequester metal cations. As such, the internal aqueous phase may comprise a one or more stripping agents.

Although the polishing formulation of the invention is generally multi-phasic, each phase (e.g., organic phase, external aqueous phase) of a multi-phasic polishing formulation may be used alone or together in different physical arrangement. In some embodiments, the external aqueous, internal aqueous, and organic phases of a W/O/W emulsion are, instead of being used in an emulsion, used in combination to form a supported liquid membrane of the invention. In such embodiments, the organic liquid membrane is supported on a porous polymeric membrane partitioning the hollow body and thus, the external and internal aqueous phases. In other variations, the organic liquid membrane is supported on a hollow and porous polymeric fiber. In such embodiments, the polymeric fiber supporting the organic membrane is immersed in the external aqueous phase while the internal aqueous phase is within the porous polymeric fiber.

The W/O/W multiple emulsion liquid membrane system could be supported in a polymeric structure (termed "Supported liquid Membrane Emulsion") within the framework of a supporting frame such that the entire polymer is one integral homogeneous or heterogeneous entity. The system may be envisioned as being soaked in a very thin porous polymeric membrane. In yet another embodiment, it may be envisioned as being supported by a hollow core polymeric structure such that the W/O/W emulsion is in the hollow core as well as the porous structure of the hollow core polymer. Essentially, no non-homogeneity exists within the body of the hollow core polymeric framework. The tri-phasic (or multiphasic) system is prevalent in the hollow core as well as within the pores of the membrane and, by virtue of pore diffusion, prevalent on the surface contacting the polish substrate and creating a boundary layer. Despite the difference in physical structure, a polishing apparatus of the invention that is based on a supported liquid membrane operates analogously to a polishing apparatus comprising an emulsion liquid membrane; that is to say, the external aqueous phase, by oxidation, for example, generates metal ions that are carried across the organic membrane by a carrier and deposited in the internal aqueous phase.

W/O/W emulsions of the following exemplary polishing formulations may be prepared as described above in reference to FIG. 10; that is to say, the preparation of a W/O/W emulsion commences by dispersing an aqueous phase in an organic phase comprising, for example, a surfactant and a complexing agent. A primary emulsion having a sufficiently small drop size may be accomplished by vigorous mechanical agitation using, for example, a high-sheer agitator at high speeds. A W/O/W emulsion is subsequently prepared by dispersing primary emulsion in an external aqueous phase using a conventional type stirrer.

In a non-limiting example of a polishing formulation for use in removing (or planarizing or polishing) copper, the formulation comprises an external aqueous phase comprising hydrogen peroxide as an oxidant (optionally with nitric acid) and benzimidazole as a corrosion inhibitor; a dodecane liquid membrane comprising octyl(phenyl)-N,N-diisobutylcarbamoylmethyl phosphine oxide (CMPO) and/or tributyl phosphate (TBP) as complexing agents; and an aqueous receiving phase comprising ammonium hydroxide (optionally with sulfuric or nitric acid) at pH 6-7. This polishing formulation may be used as a W/O/W emulsion, or used in a supported liquid membrane system (e.g., hollow fiber supported liquid membrane).

In a non-limiting example of a polishing formulation for use in removing (or planarizing or polishing) copper, the formulation comprises an external aqueous phase comprising hydrogen peroxide as an oxidant (optionally with nitric acid) and benzimidazole as a corrosion inhibitor; a dodecane liquid membrane comprising a complexing agent selected from the group consisting of crown ethers, aza crown ethers, and calixarenes; and an aqueous receiving phase comprising ammonium hydroxide (optionally with sulfuric or nitric acid) at a pH 6-7. This polishing formulation may be used as a W/O/W emulsion, or used in a supported liquid membrane system (e.g., hollow fiber supported liquid membrane).

In a non-limiting example of a polishing formulation for use in removing (or planarizing or polishing) copper, the formulation comprises an external aqueous phase comprising hydrogen peroxide as an oxidant (optionally with sulfuric acid) and benzimidazole as a corrosion inhibitor; a dodecane or chloroform liquid membrane comprising an organophosphoric acid (e.g., diethylhexylphosphoric acid) complexing agent and polyoxyethylene lauryl ether as a surfactant; and an aqueous receiving phase comprising ammonium hydroxide (optionally with sulfuric or nitric acid) at a pH 6-7. This polishing formulation may be used as a W/O/W emulsion, or used in a supported liquid membrane system (e.g., hollow fiber supported liquid membrane).

In a non-limiting example of a polishing formulation for use in removing (or planarizing or polishing) copper, the formulation comprises an external aqueous phase comprising hydrogen peroxide as an oxidant (optionally with nitric acid), benzimidazole as a corrosion inhibitor, and ammonia, wherein the external aqueous phase is at a pH of 7-8; a dodecane or chloroform liquid membrane comprising a complexing agent selected from the group consisting of 1-(2-pyridylazo)-2-naphthol (PAN), crown ethers, aza crown ethers, or calixarenes, wherein PAN, if present is in a concentration of 0.001 M; and an aqueous receiving phase comprising 0.05 M sulfosalicylic acid at pH of 6-7. This polishing formulation may be used as a W/O/W emulsion, or used in a supported liquid membrane system (e.g., hollow fiber supported liquid membrane).

In a non-limiting example of a polishing formulation for use in removing (or planarizing or polishing) copper, the formulation comprises an external aqueous phase comprising nitric acid and ascorbic acid; a 1:4 toluene:n-heptane liquid membrane comprising di-(2-ethylhexyl)phosphoric acid (D2EHPA) as a complexing agent and Span-80 as a surfactant; and an aqueous receiving phase comprising hydrochloric acid and hydrogen peroxide as an oxidant, and neocuproine (2,9-dimethyl-1,10-phenanthroline) as a complexing agent. This polishing formulation may be used as a W/O/W emulsion, or used in a supported liquid membrane system (e.g., hollow fiber supported liquid membrane). Without being bound by theory, nitric acid in the external aqueous phase oxidizes copper to form $Cu^{2+}$, which, in turn, forms a complex with ascorbic acid. The copper ion of the copper-ascorbic acid complex, upon when reaching the liquid membrane, forms a more stable complex with D2EHPA in the organic phase. The copper ion is subsequently stripped form the copper-D2EHPA complex at the liquid membrane/internal aqueous phase interface where it reacts with neocuproine to form a third complex. Hydrogen peroxide in the inner aqueous phase ensures the copper remains in the $Cu^{2+}$ state to facilitate the strong complexation.

In a non-limiting example of a polishing formulation for use in removing (or planarizing or polishing) copper, the formulation comprises an external aqueous phase comprising sulfuric acid as oxidant at acidic pH (<7); a liquid membrane comprising di-(2-ethylhexyl)phosphoric acid (D2EHPA) as complexing agent and Span-80 as a surfactant; and an aqueous receiving phase comprising. This polishing formulation may be used as a W/O/W emulsion, or used in a supported liquid membrane system (e.g., hollow fiber supported liquid membrane).

In a non-limiting example of a polishing formulation for use in removing (or planarizing or polishing) copper, the formulation comprises an external aqueous phase containing ammonium thiocyanate as a complexing agent, a dichloroethane liquid membrane comprising polyethylene glycol as a complexing agent and a surfactant; and an aqueous receiving phase comprising potassium hydroxide. This polishing formulation may be used as a W/O/W emulsion, or used in a supported liquid membrane system (e.g., hollow fiber supported liquid membrane).

Methods

A variety of methods for polishing a metallized surface of a polish substrate are possible using the polymeric substrates, polishing formulations, and polishing apparatus described herein. In general, the polymeric substrates, polishing formulations, and polishing apparatus described herein may be used alone or in any combination in methods for polishing a metallized surface. The polishing formulations used in the methods may be substantially, essentially, or entirely free of abrasive additives. Further, some variations of the methods may not require mechanical motion of either the polymeric substrate or the polish substrate. In particular, methods may not require mechanical friction between the polymeric substrate and the polish substrate.

In general, the methods comprise mounting a polish substrate to be polished in a polish substrate holder (e.g., wafer chuck) so that the metallized surface to be polished opposes a polymeric surface of a polymeric substrate. The polish substrate may be positioned such the metallized surface contacts the polymeric surface with very little downforce as described above, or in some variations, the metallized surface may not contact the polymeric surface of the polymeric substrate. Any suitable polymeric substrate described herein or later developed may be used. As described above, in some instances the polymeric surface of the polymeric substrate may be porous to one or more components of a polishing formulation.

The methods also include modifying the metallized surface of the substrate so that one or more metals or metal-containing species on the metallized surface can be dissolved by an aqueous solution. Such hydration of the metals or metal-containing species may be accomplished using any suitable technique. For example, as described above, the metal surface may be oxidized to produce metal cations. The solubility of metal cations so formed in an aqueous solution may be adjusted using any suitable technique, e.g., by the use of acids or bases. As will be described in more detail below, in some instances, the surface may be modified electrochemically to produce water-soluble metal cations.

In the methods, an aqueous boundary layer (or latent boundary layer) is formed on a polymeric surface of a polymeric substrate. Once a metallized surface is modified to form water-soluble metallic cations, the methods may comprise contacting the modified surface with the aqueous boundary layer (or latent boundary layer) and dissolving the metallic cations into the boundary layer. By adjusting the height of the metallized surface above the boundary layer (or the pressure of the metallized surface on the polymeric surface), selected regions of the metallized surface may be polished. For example, the tallest protrusions extending from a metallized surface may be the only portions to contact the boundary layer.

The methods may comprise contacting a polishing formulation comprising an external aqueous phase and an organic phase with the aqueous boundary layer (or latent boundary layer) that comprises the solvated metal cations, so that the solvated cations enter the external aqueous phase of the polishing formulation, e.g., by diffusion. The organic phase and the external aqueous phase of the polishing formulation may or may not form an emulsion, as described above. Further, polishing formulations used in the methods may comprise multiple emulsions, e.g., a W/O/W emulsion as described above. It should be noted that the boundary layer (or latent boundary layer) may in some instances be formed from or comprise the external aqueous phase of the polishing formulation. In the case where the boundary layer (or latent boundary layer) comprises the external aqueous phase, the boundary layer may be a W/O/W emulsion, the external aqueous phase of which is in direct contact with the polish substrate. The methods comprise extracting the metallic cations from the external aqueous phase of the polishing formulation, or transporting the metallic cations across a liquid membrane between the external aqueous phase and the organic phase, as described above. For example, some methods may comprise utilizing an organic phase comprising a complexing agent, and the complexing agent may complex the solvated metal cations to extract them from the external aqueous phase.

Of course, the methods may comprise selecting or adjusting a polishing formulation for a particular application. For example, a polishing formulation may be selected or adjusted for use with a particular type of polymeric substrate, e.g., a polymeric substrate comprising a hollow body or a body comprising a network of open pores. The polymeric substrate, whether the polymeric substrate has a hollow body or body comprising a network of open pores, serves as a reservoir and conduit for the polishing formulation (e.g., W/O/W emulsion, or one or more phases thereof). Thus, the polymeric substrate supplies (as well as removes) polishing formulation to the pores of the porous polymeric surface. As described above, polishing formulations may also be selected or adjusted according to the material that is being removed, the rate of polishing desired and/or the degree of local or global flatness desired.

One variation of a method that may be used for polishing a substrate may be described by reference to FIG. 2. There, a polish substrate (201) is mounted with its relatively rough metallized surface comprising protrusions (202) to be polished opposed to the polymeric surface (203) of the polymeric substrate (206). Furthermore, the polish substrate (201) is suspended (e.g., with a wafer chuck) at a height above the surface (203) comprising an aqueous boundary layer is disposed thereon so as to allow selected regions of the metallized surface, e.g., a selected subset of the protrusions (202) having a minimum height, to contact the boundary layer and solvate metal cations formed from the metallized surface. Alternatively, the polish substrate (201) is pressed into polishing formulation-saturated polymeric surface (203) with a downforce proportional to the amount of polishing formulation (220) required to interact with protrusions (202). The solvated metal cations may then be transferred from the boundary layer to the external aqueous phase (221) of the polishing formulation (220), and extracted from the external aqueous phase into the organic phase (222), as described above. In certain variations of the methods, the organic phase of the polishing formulation may comprise an internal aqueous phase that is configured to strip metal cations from metal-containing complexes in the organic phase. In the methods, the polishing formulation may be at least partially contained within a body of a polymeric substrate, as illustrated in FIGS. 2 and 3, or may be otherwise delivered to the polymeric substrate, as described above.

As stated above, the surface of the polymeric substrate used in the methods may be porous. Thus, in some methods, the extraction of the metal cations from the external aqueous phase may take place at least partially within a body of a polymeric substrate, e.g., within a cavity in a polymeric substrate body, and/or in a reservoir in fluid communication with the polymeric substrate. Thus, certain methods may comprise permeating an organic phase of a polishing formulation through the porous polymeric surface of the polymeric substrate and/or permeating an aqueous phase of a polishing formulation through the porous polymeric substrate surface.

Any of the methods described herein may be adapted to remove one or more of a variety of metals or metal-containing species from a metallized surface. For example, certain variations of the methods may be adapted for removing any metal or metal-containing species commonly or otherwise encountered during the polishing of wafers for the production of integrated circuits. Non-limiting examples of metals or metal-containing species that may be removed using the methods described herein include copper, oxides of copper, tantalum, tantalum nitride, and titanium. Additional metals metal-containing species include antimony, arsenic, bismuth, cadmium, chromium, copper, cobalt, gallium, gold, hafnium, indium, iridium, iron, lead, manganese, molybdenum, neodymium, nickel, niobium, osmium, palladium, platinum, rhenium, rhodium, ruthenium, silver, tantalum, tellurium, thallium, thorium, tin, tungsten, uranium, vanadium, titanium, zinc, zirconium, and/or rare earth metals. Methods may be adapted to selectively remove one or metals or metal-containing species, or combinations of metals and metal-containing species, from a metallized surface comprising multiple metals or metal-containing species, or combinations of one or more metals and one or more metal-containing species.

The methods may, but need not, comprise agitating an aqueous phase or an organic phase used. For example, at least one of the external aqueous phase or the organic phase may be agitated. Certain methods may comprise moving, e.g., rotating and/or translating, at least one of the polymeric substrate and the polish substrate relative to the other of the polymeric substrate and the polish substrate. For example, either or both the polymeric substrate and the polish substrate may be rotated and/or translated relative to each other.

As stated above, some methods may include electrochemical modification of a metallized surface to form water-soluble cations as depicted in FIG. 19. Any suitable technique may be used to pass current through a metallized surface of a polish substrate to facilitate electrochemical dissolution of metal or metal-containing species from the metallized surface into an aqueous solution in contact therewith. For example, a polymeric substrate may be coupled with an electrochemical cell assembly. In one possible configuration, the metallized surface of the polish substrate may be a positively charged anode of an electrochemical cell, and one or more surfaces of the polymeric pad may be a negatively charged cathode so as to form an electrochemical current and facilitate dissolution of metal ions from the metallized surface into the aqueous solution. Electrochemical means may be used for as often or as long as necessary to achieve the desired rate of oxidation and dissolution of metal or metal-containing species. As such, electrochemical oxidation of the metallized surface may be started, stopped, or pulsed as needed. In another situation, the charge on the droplets of the dispersed phase at the interface may be made sufficiently negative through the choice of appropriate surface active agents or surfactants such as surfactant 905 depicted in FIG. 19. There could be a sulphate ion for example terminating on the hydrophilic segment of the surfactant used in the outer emulsion formed with the bulk aqueous phase. This leads to the creation of multiple and numerous miniscule (micro—and nano—level) electrochemical cells within the W/O/W emulsion system with the metallized polish substrate charged positively as an anode. This can enhance metal dissolution due to the electrochemical reactions resulting in enhancement of the transfer rate of the metal ions from the substrate to the interface of the liquid membrane emulsion.

Any of the methods described herein for polishing a substrate by removing one or more metals or metal-containing species from a metallized surface may further comprise one or more steps to recover metallic species so removed. For example, if an organic phase has been used to extract metal ions from an aqueous phase, and the organic phase is not emulsified with the aqueous phase, the organic phase may be stripped of metal-containing species or complexes using techniques described herein, now known, or later developed. If the extracted metallic species is contained within one or more emulsions as described above, one or more de-emulsification steps may be performed and the resulting de-emulsified phase may be stripped of metal-containing species or complexes.

What is claimed is:

1. A polishing apparatus for removing metal and/or metal-containing species from a metallized surface of a polish substrate to form a polished surface, the apparatus comprising:

a polish substrate holder configured to support the polish substrate; and a polymeric substrate comprising a polymeric surface configured to interface with the metallized surface, wherein an aqueous phase of a polishing formulation disposed in a boundary region between the polymeric surface and the metallized surface solvates metal cations formed from the metal and/or metal-containing species, an organic phase of the polishing formulation extracts solvated metal cations from an external aqueous phase of the aqueous phase of the polishing formulation, and extraction of solvated metal cations from the external aqueous phase of the polishing formulation occurs at least partially within a body of the polymeric substrate.

2. The polishing apparatus of claim 1, wherein the organic phase of the polishing formulation comprises a complexing agent for extracting the solvated metal cations from the external aqueous phase of the polishing formulation.

3. The polishing apparatus of claim 1, wherein the organic phase of the polishing formulation forms an emulsion with the external aqueous phase of the polishing formulation.

4. The method of claim 1, wherein the metal and/or metal-containing species is one selected from the group consisting of copper, tantalum, titanium, copper oxide, and tantalum nitride.

5. The polishing apparatus of claim 1, wherein the wherein the organic phase of the polishing formulation forms an emulsion with an internal aqueous phase of the polishing formulation.

6. The polishing apparatus of claim 5, wherein the internal aqueous phase of the polishing formulation comprises a stripping agent for extracting metal cations from the organic phase of the polishing formulation.

* * * * *